US006977467B2

(12) United States Patent
Kawanishi

(10) Patent No.: US 6,977,467 B2
(45) Date of Patent: Dec. 20, 2005

(54) PLASMA DISPLAY PANEL WITH CURVED PARTITION WALL

(75) Inventor: Yoshitaka Kawanishi, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 132 days.

(21) Appl. No.: 10/657,101

(22) Filed: Sep. 9, 2003

(65) Prior Publication Data

US 2004/0046505 A1 Mar. 11, 2004

(30) Foreign Application Priority Data

Sep. 10, 2002 (JP) ..... 2002-264352

(51) Int. Cl.[7] ..... H01J 17/49
(52) U.S. Cl. ..... 313/582; 313/584; 313/292
(58) Field of Search ..... 313/493, 582, 313/584, 634, 238, 292

(56) References Cited

U.S. PATENT DOCUMENTS 6,661,170 B2 * 12/2003 Amemiya ..... 313/582

FOREIGN PATENT DOCUMENTS

| | | | |
|---|---|---|---|
| JP | 11-339669 | A | 12/1999 |
| JP | 2000-340123 | A | 12/2000 |
| JP | 2001-319580 | A | 11/2001 |
| KR | 2001-0078094 | | 8/2001 |
| KR | 2001-283738 | | 10/2001 |

* cited by examiner

*Primary Examiner*—Vip Patel
(74) *Attorney, Agent, or Firm*—Sughrue Mion, PLLC

(57) ABSTRACT

A rear substrate in a plasma display panel including a first substrate through which an image is transmitted to a viewer, and the rear substrate arranged in facing relation to the first substrate, includes (a) an electrically insulating substrate, (b) a plurality of data electrodes arranged on the substrate and spaced away from one another, (c) a plurality of partition walls formed on the substrate, and (d) a phosphor layer covering the substrate and the data electrodes therewith between adjacent partition walls, wherein at least one partition wall and another partition wall among the partition walls are joined to each other at at least one of opposite ends thereof in a length-wise direction through a curved partition wall, the another partition wall extending in the same direction as a direction in which the at least one partition wall extends.

20 Claims, 18 Drawing Sheets

| MEASUREMENT POINT | HEIGHT [μm] | MEASUREMENT POINT | HEIGHT [μm] |
|---|---|---|---|
| ① | 132 | ⑫ | 121 |
| ② | 128 | ⑬ | 126 |
| ③ | 122 | ⑮ | 125 |
| ⑤ | 133 | | |
| ⑥ | 125 | | |
| ⑧ | 129 | | |
| ⑩ | 127 | | |

| MEASUREMENT POINT | HEIGHT [μm] | MEASUREMENT POINT | HEIGHT [μm] |
|---|---|---|---|
| ① | 128 | ⑬ | 127 |
| ② | 121 | ⑭ | 125 |
| ⑤ | 134 | ⑮ | 123 |
| ⑥ | 124 | ⑯ | 112 |
| ⑦ | 131 | ⑲ | 121 |
| ⑧ | 138 | ⑳ | 126 |
| ⑪ | 122 | A | 110 |
| ⑫ | 122 | | |

| MEASUREMENT POINT | HEIGHT [μm] | MEASUREMENT POINT | HEIGHT [μm] |
|---|---|---|---|
| ① | 131 | ⑬ | 136 |
| ② | 125 | ⑭ | 123 |
| ③ | 124 | ⑮ | 129 |
| ④ | 130 | ⑯ | 131 |
| ⑤ | 123 | ⑰ | 129 |
| ⑧ | 130 | ⑳ | 119 |
| ⑨ | 118 | A | 128 |
| ⑫ | 128 | B | 122 |

| MEASUREMENT POINT | HEIGHT [μm] | MEASUREMENT POINT | HEIGHT [μm] |
|---|---|---|---|
| ① | 133 | A | 131 |
| ② | 124 | D | 126 |
| ③ | 133 | F | 130 |
| ④ | 125 | H | 131 |
| ⑤ | 130 | I | 126 |
| ⑥ | 133 | M | 127 |
| ⑩ | 133 | N | 127 |
| ⑫ | 122 | P | 118 |
| ⑰ | 115 | S | 121 |
| ⑱ | 117 | T | 126 |

PLASMA DISPLAY PANEL WITH CURVED PARTITION WALL

BACKGROUND OF THE INVENTION

1. Field of the Invention

The invention relates to a plasma display panel, and more particularly to a plasma display panel which is capable of preventing display defectiveness caused by breakage and/or defective shape of partition walls.

2. Description of the Related Art

A plasma display panel is recently often used as a flat display, because a plasma display panel has advantages that it is thin and can be readily applied to a big screen, it has a broad viewing angle, and it has a high response speed.

FIG. 1 is a perspective view of a display cell in a conventional three-electrode surface-discharge AC type plasma display panel.

As illustrated in FIG. 1, a front substrate 351 and a rear substrate 352 are arranged parallel to each other in a display cell.

The front substrate 351 is comprised of an electrically insulating substrate 302 composed of transparent material such as glass, a plurality of scanning electrodes 303 (only one of them is illustrated in FIG. 1) formed on the substrate 302 in facing relation to the rear substrate 352, a plurality of common electrodes 304 (only one of them is illustrated in FIG. 1) formed on the substrate 302 in facing relation to the rear substrate 352, a plurality of trace electrodes 305 each formed on each of the scanning electrodes 303, a plurality of trace electrodes 306 each formed on each of the common electrodes 304, a dielectric layer 312 formed on the substrate 302, covering the scanning electrodes 303, the common electrodes 304 and the trace electrodes 305 and 306 therewith, and a protection layer 313 formed on the dielectric layer 312.

The scanning electrodes 303 and the common electrodes 304 are arranged alternately, and equally spaced away from adjacent ones in parallel with one another.

The trace electrodes 305 and 306 reduce an electrical resistance of the scanning electrode 303 and the common electrode 304, respectively.

The protection layer 313 protects the dielectric layer 312 from discharges. The protection layer 313 is composed of magnesium oxide (MgO), for instance.

The rear substrate 352 is comprised of an electrically insulating substrate 301 composed of transparent material such as glass, a plurality of data electrodes 307 formed on the substrate 301 in a direction perpendicular to a direction in which the scanning electrodes 303 and the common electrodes 304 extend, in facing relation to the front substrate 351, a dielectric layer 341 formed on the substrate 301, covering the data electrodes 307 therewith, a partition wall 315 formed on the dielectric layer 314, and a phosphor layer 311 covering an exposed surface of the dielectric layer 314 and sidewalls of the partition wall 315 therewith.

The substrate 301 in the rear substrate 352 is comprised of a transparent substrate in the display cell illustrated in FIG. 1, however, it is not always necessary for the substrate 301 to be a transparent substrate.

The partition wall 315 defines a discharge gas space and a plurality of display cells (pixels) 308.

Viewing perpendicularly to a surface of the substrate 301, the partition wall 315 is grid-shaped. Specifically, the partition wall 315 is comprised of a vertical partition wall 315*a* extending in parallel with the data electrodes 317, and a horizontal partition wall 315*b* extending perpendicularly to the vertical partition wall 315*a*.

The vertical and horizontal partition walls 315*a* and 315*b* are almost equal in height to each other. A height from a surface of the substrate 301 to a summit of the partition wall 315, that is, a total thickness of the dielectric layer 314 and the partition wall 315 is 120 micrometers, for instance.

Each of the display cells 308 is filled with discharge gas composed of noble gas such as helium, neon or xenon singly or in combination.

The phosphor layer 311 receives ultra-violet rays generated due to discharges of discharge gas, and thus, emits a visible light 310.

An area between the front substrate 351 and the rear substrate 352 is comprised of a centrally located display area in which images are displayed, and a non-display area located around the display area. A partition wall formed in a non-display area is called a dummy partition wall, which assists a partition wall to be uniformly formed in a display area during fabrication of a plasma display panel, and prevents contaminants from entering a display area for protection of a display area after fabrication of a plasma display panel. A dummy partition wall is formed generally by one or two rows.

FIGS. 2A to 4B show respective step in a method of fabricating the conventional plasma display panel illustrated in FIG. 1. FIGS. 2A, 3A and 4A are plan views of the rear substrate 352, and FIGS. 2B, 3B and 4B are cross-sectional views taken along the lines 2B, 3B and 4B in FIGS. 2A, 3A and 4A, respectively.

Hereinbelow is explained a method of fabricating the conventional plasma display panel with reference to FIGS. 2A to 4B.

With reference to FIG. 1, the scanning electrodes 303 and the common electrodes 304 are formed on the substrate 302 such that they are alternately arranged and extend in parallel with each other.

Then, the trace electrodes 305 and 306 are formed on the scanning and common electrodes 303 and 304, respectively.

Then, the dielectric layer 312 is formed on the substrate 302 such that the dielectric layer 312 covers the scanning and common electrodes 303 and 304 and the trace electrodes 305 and 306 therewith.

Then, the protection layer 313 composed of MgO is formed on the dielectric layer 312.

Thus, there is fabricated the front substrate 351.

With reference to FIGS. 2A and 2B, a plurality of the data electrodes 307 is formed on the substrate 301.

Then, as illustrated in FIGS. 3A and 3B, the dielectric layer 314 is formed on the substrate 301 such that the dielectric layer 314 covers the data electrodes 307 therewith.

Then, as illustrated in FIGS. 4A and 4B, the partition wall 315 is formed on the dielectric layer 314.

The partition wall 315 can be formed by sand blasting or printing, for instance. The partition wall 315 is formed as follows in the case that the partition wall 315 is formed by sand blasting.

First, filler, glass powder, binder and solvent are mixed to thereby have partition wall paste.

Then, the partition wall paste is coated on the dielectric layer 314. Then, the solvent in the paste is evaporated to thereby form a partition wall paste layer (not illustrated).

Then, a dry film (not illustrated) is adhered onto a surface of the partition wall paste layer, and then, the dry film is patterned.

Then, sand blasting is carried out to the partition wall paste layer with the patterned dry film being used as a mask.

As a result, a portion of the partition wall paste layer not covered with the dry film is selectively removed.

Then, the dry film is removed, and the partition wall paste layer is baked. As a result, the binder in the partition wall paste layer is evaporated, and the glass powder is fused and re-cured. Thus, there is formed the partition wall 315 composed of filler and glass.

The partition wall 315 is formed in a grid such that the vertical and horizontal partition walls 315*a* and 315*b* are almost equal in height to each other.

Then, as illustrated in FIG. 1, the phosphor layer 311 is formed on an exposed surface of the dielectric layer 314 and sidewalls of the partition wall 315.

Then, the substrates 301 and 302 are aligned with each other such that the protection layer 313 makes contact with the partition wall 315 and that the data electrodes 307 extend perpendicularly to the scanning and common electrodes 303 and 304.

Then, the substrates 301 and 302 aligned with each other are thermally annealed, resulting in that the substrates 301 and 302 are fused at their ends to each other through flits. Thus, a space surrounded by a sealing layer (not illustrated) comprised of the substrates 301 and 302 and the flits is gas-tightly sealed.

Then, the space is exhausted, and thereafter, discharge gas is introduced into the space.

Thus, there is completed the plasma display panel illustrated in FIG. 1.

However, the above-mentioned conventional plasma display panel is accompanied with a problem of poor quality in displaying images which is caused by contraction of a partition wall paste layer generated during being baked. Hereinbelow is explained the problem of contraction of a partition wall paste layer.

The above-mentioned poor quality in displaying images is grouped into two types.

The first type poor quality is caused by that the vertical partition wall 315*a* is partially raised during the partition wall paste layer is being baked. The first type poor quality is caused because the vertical partition wall 315*a* is longer and thinner than the horizontal partition wall 315*b*.

Since the vertical partition wall 315*a* is longer and thinner than the horizontal partition wall 315*b*, the vertical partition wall 315*a* and the horizontal partition wall 315*b* are different from each other with respect to contraction generated during the partition wall 315 is being baked, and hence, the vertical partition wall 315*a* is partially raised to thereby become higher than the horizontal partition wall 315*b*.

As a result, when the substrates 301 and 302 are aligned to each other, a raised portion of the vertical partition wall 315*a* is compressed by the protection layer 313, and resultingly, the vertical partition wall 315*a* is often broken. If the vertical partition wall 315*a* is broken, a portion of the phosphor layer 311 formed on the vertical partition wall 315*a* itself and sidewalls of the vertical partition wall 315*a* is scattered into the display cell 308, and resultingly, adheres to the scanning electrode 303 and/or the common electrode 304. This results in that the display cell 308 does not properly operate, that is, the display cell 308 is kept to emit a light regardless of a drive signal or does not emit a light at all.

The second type poor quality is caused by that the vertical and horizontal partition walls 315*a* and 315*b* are contracted during the partition wall 315 is being baked, and resultingly, opposite ends of the vertical and horizontal partition walls 315*a* and 315*b* in a length-wise direction are deformed to be higher than centers of them.

FIG. 5A is a cross-sectional view illustrating the partition wall 315 before baked, FIG. 5B is a cross-sectional view illustrating the partition wall 315 after baked, and FIG. 5C is a cross-sectional view illustrating the substrates 301 and 302 aligned to each other. For simplification, parts other than the substrates 301 and 302 and the partition wall 315 are omitted in FIGS. 5A to 5C.

As illustrated in FIG. 5A, the partition wall 315 before baked has a uniform height.

However, as illustrated in FIG. 5B, the partition wall 315 is contracted during being baked, and resultingly, opposite ends 315*c* are raised relative to a central portion 315*d*.

As illustrated in FIG. 5C, the substrates 301 and 302 are aligned to each other, and then, a discharge gas space is exhausted. The substrates 301 and 302 are bent due to atmospheric pressure. However, the substrates 301 and 302 are bent in a different curvature from the partition wall 315, and accordingly, gaps 316 are formed between the partition wall 315 and the substrate 302 in the vicinity of the ends 315*c*.

As a result, a display cell 308 including the gaps 316 would have an increased volume, and hence, a voltage necessary for generating writing discharge in the display cell 308 would be raised. Thus, writing discharge would not be generated by an ordinary drive voltage in the display cell 308, resulting in writing defectiveness. Thus, the plasma display panel would have a problem of display defectiveness.

There have been suggested solutions to the second type poor quality.

For instance, Japanese Patent Application Publication No. 2001-319580 has suggested a plasma display panel in which a dielectric layer is not formed in a non-display area on a rear substrate, and a partition wall is formed directly on the rear substrate in order to prevent the above-mentioned second type poor quality. This ensures that a partition wall located in a non-display area is lower in height than a partition wall located in a display area. Hence, even if a partition wall is contracted, and accordingly, opposite ends thereof in a length-wise direction become higher than a central area, it would be possible to prevent formation of gaps between the partition wall and a front substrate.

In contrast to the second type poor quality, the first type poor quality is not well recognized, and accordingly, solutions are not much suggested.

For instance, the plasma display panel suggested in the above-mentioned Japanese Patent Application Publication No. 2001-319580 prevents the second type poor quality, but cannot prevent the first type poor quality.

Japanese Patent Application Publication No. 2000-340123 has suggested a plasma display panel which includes an improved horizontal partition wall in order to prevent the first type poor quality.

FIG. 6 is a plan view of a partition wall in the plasma display panel suggested in Japanese Patent Application Publication No. 2000-340123.

As illustrated in FIG. 6, the partition wall is comprised of a plurality of horizontal partition walls 315A horizontally extending, and a plurality of vertical partition walls 315B extending vertically only between adjacent horizontal partition walls 315A.

Each of the horizontal partition walls 315A is designed to have extensions 315C extending from opposite ends thereof Even if the horizontal partition walls 315A is raised at its opposite ends due to the contraction, such a raise is concentrated to the extensions 315C. Front and rear substrates are joined to each other between the extensions 315C formed at opposite ends of the horizontal partition wall 315A. Accordingly, front and rear substrates can be joined to each other with a constant gap being kept therebetween without being influenced by the raised extensions 315C.

Japanese Patent Application Publication No. 11-339668 has suggested a plasma display panel including a partition wall having opposite tapered ends 315D, as illustrated in FIG. 7, to prevent formation of a raise portion caused by contraction.

The plasma display panel suggested in Japanese Patent Application Publication No. 2000-340123 makes it possible for front and rear substrates to join to each other with a constant gap being kept therebetween. However, since the extensions 315C are raised, if the front and rear substrates are misaligned even slightly, the front substrate aligns with the raised extensions 315C, resulting in that it would not be possible to keep a constant gap between the front and rear substrates.

Accordingly, it is necessary to align the front and rear substrates to each other highly accurately before they join to each other. This causes an additional problem that steps of fabricating a plasma display panel are unavoidably complicated.

The partition wall suggested in Japanese Patent Application Publication No. 11-339668 is formed by physically grinding, punching or a process of half-exposing a partition wall to a light.

If the tapered ends 315D are formed by grinding, there are newly caused problems that a grinding step has to be additionally carried out, and chips are generated in a grinding step.

If the tapered ends 315D are formed by punching or half-exposing process, there are newly caused problems that an equipment for doing so has to be newly prepared, and hence, punching or half-exposing process cannot be applied to a conventional method of forming a partition wall by sand blasting.

SUMMARY OF THE INVENTION

In view of the above-mentioned problems in the conventional plasma display panels, it is an object of the present invention to provide a plasma display panel which is capable of preventing a partition wall from partially rising due to contraction during baked, without an increase in fabrication steps and further without an increase in complex in fabrication process.

In one aspect of the present invention, there is provided a rear substrate in a plasma display panel including a first substrate through which an image is transmitted to a viewer, and the rear substrate arranged in facing relation to the first substrate, including (a) an electrically insulating substrate, (b) a plurality of data electrodes arranged on the substrate and spaced away from one another, (c) a plurality of partition walls formed on the substrate, and (d) a phosphor layer covering the substrate and the data electrodes therewith between adjacent partition walls, wherein at least one partition wall and another partition wall among the partition walls are joined to each other at at least one of opposite ends thereof in a length-wise direction through a curved partition wall, the another partition wall extending in the same direction as a direction in which the at least one partition wall extends.

For instance, the at least one partition wall and the another partition wall are arranged adjacent to each other.

For instance, the partition walls include first, second, third and fourth partition walls arranged in this order, and wherein the first and third partition walls are connected at at least one of opposite ends thereof in a length-wise direction to each other through a first curved partition wall, the second and fourth partition walls are connected at at least one of opposite ends thereof in a length-wise direction to each other through a second curved partition wall, and the first and second curved partition walls intersect with each other.

For instance, every N partition walls among the partition walls are connected at at least one of opposite ends thereof in a length-wise direction to each other through the curved partition wall, the N being a positive integer equal to or greater than one.

For instance, a first pair of partition walls among the partition walls is connected at at least one of opposite ends thereof in a length-wise direction to each other through the curved partition wall, a second pair of partition wall is surrounded by the first pair of partition walls, and the second pair of partition walls among the partition walls is connected at at least one of opposite ends thereof in a length-wise direction to each other through the curved partition wall.

For instance, the partition walls are comprised of 2N partition walls, N being a positive integer equal to or greater than two, and wherein a M-th partition wall is connected at at least one of opposite ends thereof in a length-wise direction to an associated end of a (2N−M+1)-th partition wall through the curved partition wall, M being a positive integer in the range of one (1) to N both inclusive.

In the above-mentioned case, it is preferable that a curved partition wall connecting the M-th partition wall and the (2N−M+1)-th partition wall to each other therethrough has a width equal to or greater than a width of a curved partition wall connecting a (M+1)-th partition wall and a (2N−M)-th partition wall to each other therethrough.

In the above-mentioned case, it is preferable that one of the M-th partition wall and the (2N−M+1)-th partition wall wherein M is equal to one (1) is located outermost of a display area of the plasma display panel.

For instance, the curved partition wall is semi-circular.

For instance, the partition walls extend in a first direction in parallel with one another.

It is preferable that each of the partition walls is comprised of a first partition wall extending in a first direction and a second partition wall extending in a second direction perpendicular to the first direction.

It is preferable that each of the partition walls is comprised of a first partition wall extending in a first direction and a second partition wall extending in a second direction perpendicular to the first direction only between adjacent first partition walls.

It is preferable that the rear substrate may include a display area in which images are displayed, and a non-display area surrounding the display area, in which images are not displayed, the rear substrate includes flit-stoppers arranged in the non-display area in facing relation to a pair of partition walls connected at at least one of opposite ends thereof in a length-wise direction to each other through the curved partition wall, the flit-stoppers are comprised of curved lines, and the flit-stoppers are arranged each overlapping adjacent flit-stoppers, and surround the display area.

For instance, each of the flit-stoppers is circular.

In another aspect of the present invention, there is provided a plasma display panel comprising a first substrate through which an image is transmitted to a viewer, and a second substrate arranged in facing relation to the first substrate, the first substrate including (A) a first transparent substrate, (B) at least one scanning electrode formed on the first transparent substrate in facing relation to the second substrate, (C) at least one common electrode formed on the first transparent substrate in facing relation to the second substrate, and (D) a dielectric layer covering the first transparent substrate, the scanning electrode and the common electrode therewith, the second substrate being comprised of the above-mentioned rear substrate.

The advantages obtained by the aforementioned present invention will be described hereinbelow.

In accordance with the present invention, it is possible to make a gap between a designed total thickness of a dielectric layer and a partition wall and an actual one smaller than the same in a conventional plasma display panel, and further possible to prevent a partition wall from being broken and having an improper shape more surely than a conventional plasma display panel.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 1:
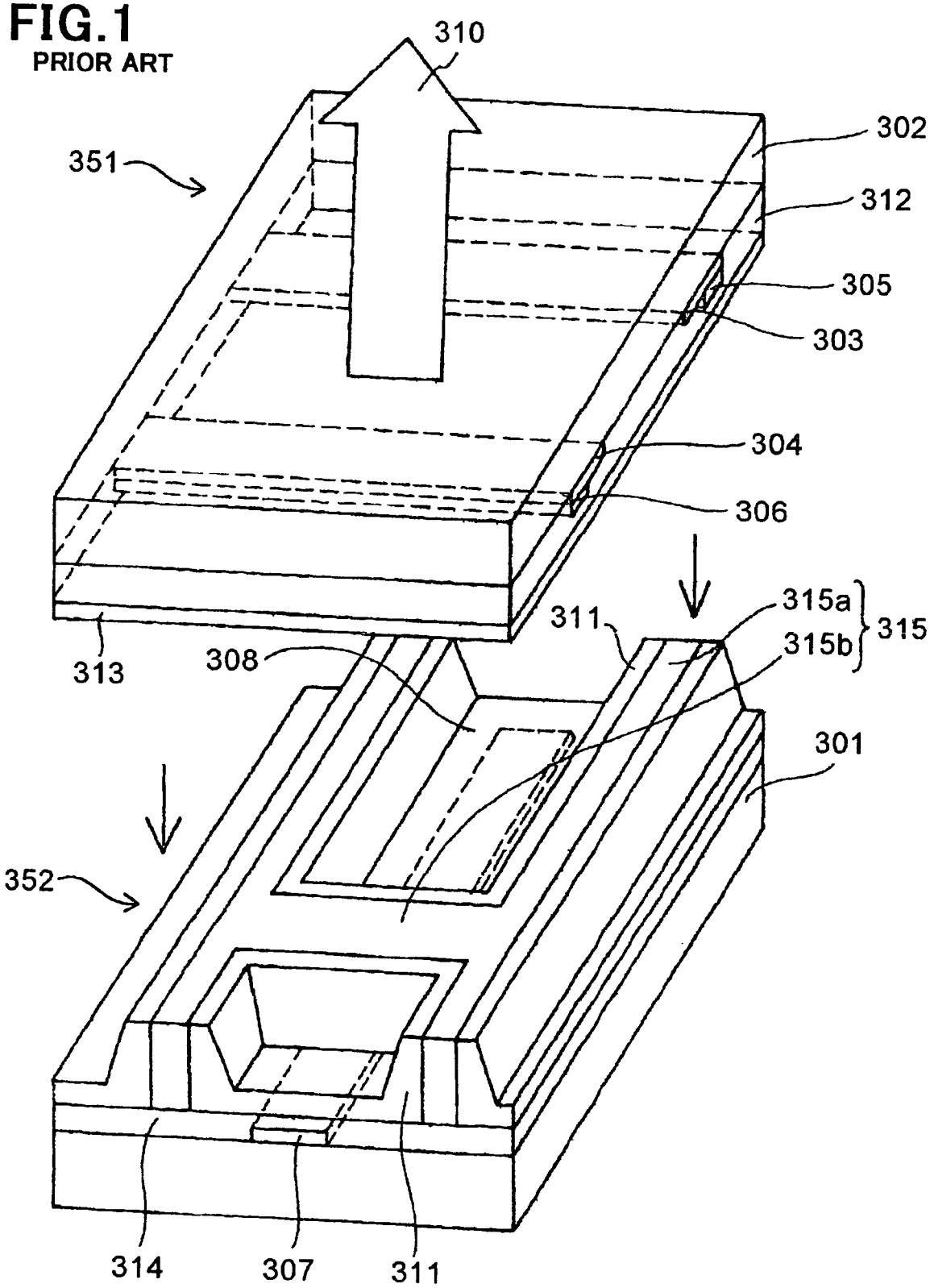
FIG.1 PRIOR ART
FIG. 1 is a perspective view of a display cell in a conventional three-electrode surface-discharge AC type plasma display panel.
Figure 2A:
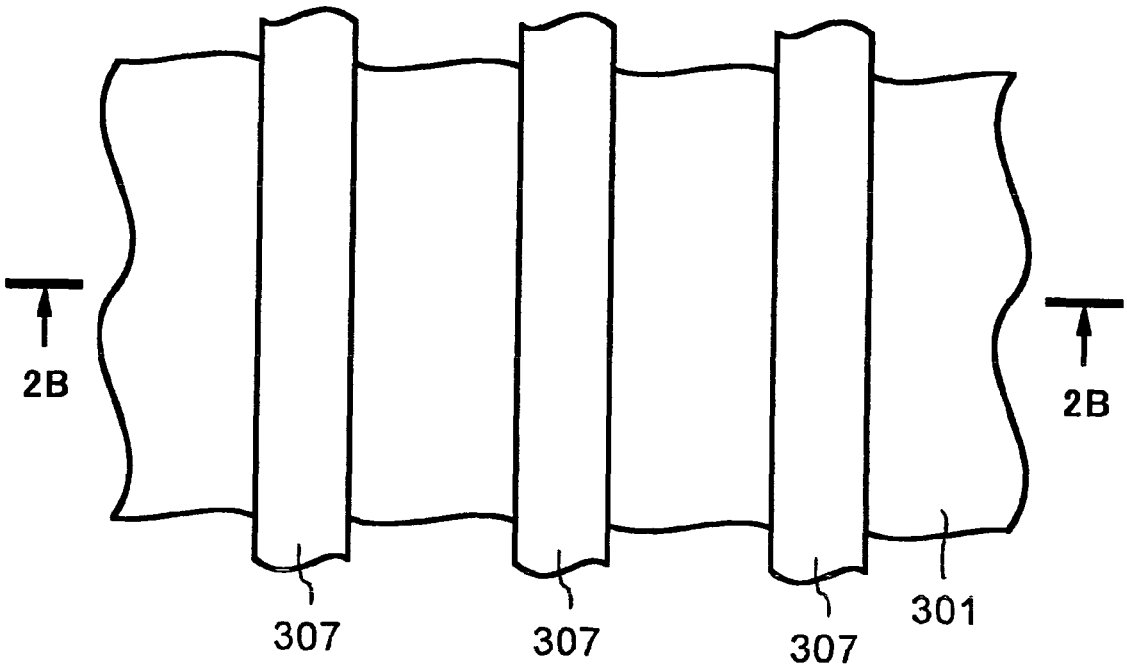
FIG.2A PRIOR ART
FIG. 2A is a plan view of a rear substrate in the plasma display panel illustrated in FIG. 1, showing respective step of a method of fabricating the plasma display panel illustrated in FIG. 1.
Figure 2B:
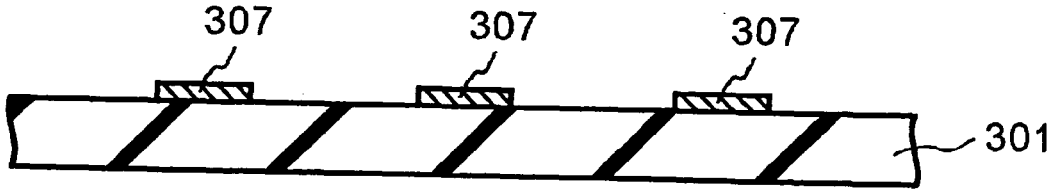
FIG.2B PRIOR ART
FIG. 2B is a cross-sectional view taken along the line 2B—2B in FIG. 2A.
Figure 3A:
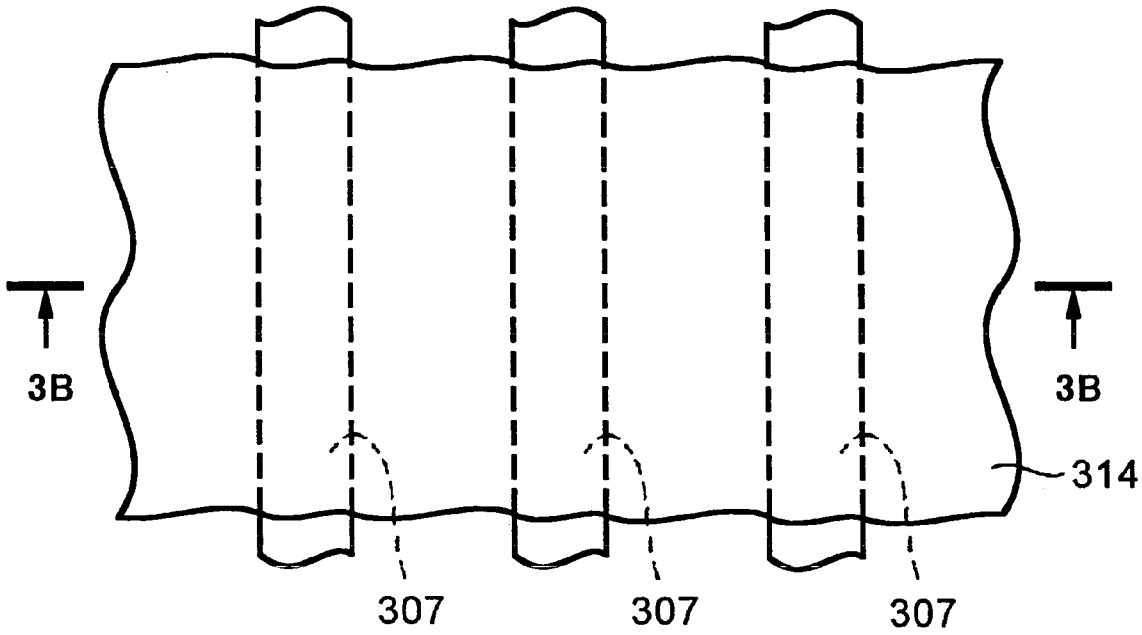
FIG.3A PRIOR ART
FIG. 3A is a plan view of a rear substrate in the plasma display panel illustrated in FIG. 1, showing respective step of a method of fabricating the plasma display panel illustrated in FIG. 1.
Figure 3B:
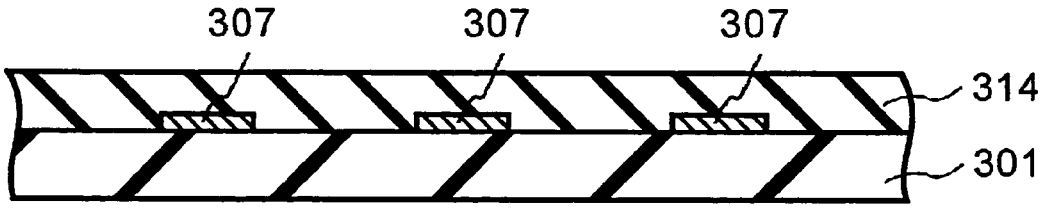
FIG.3B PRIOR ART
FIG. 3B is a cross-sectional view taken along the line 3B—3B in FIG. 3A.
Figure 4A:
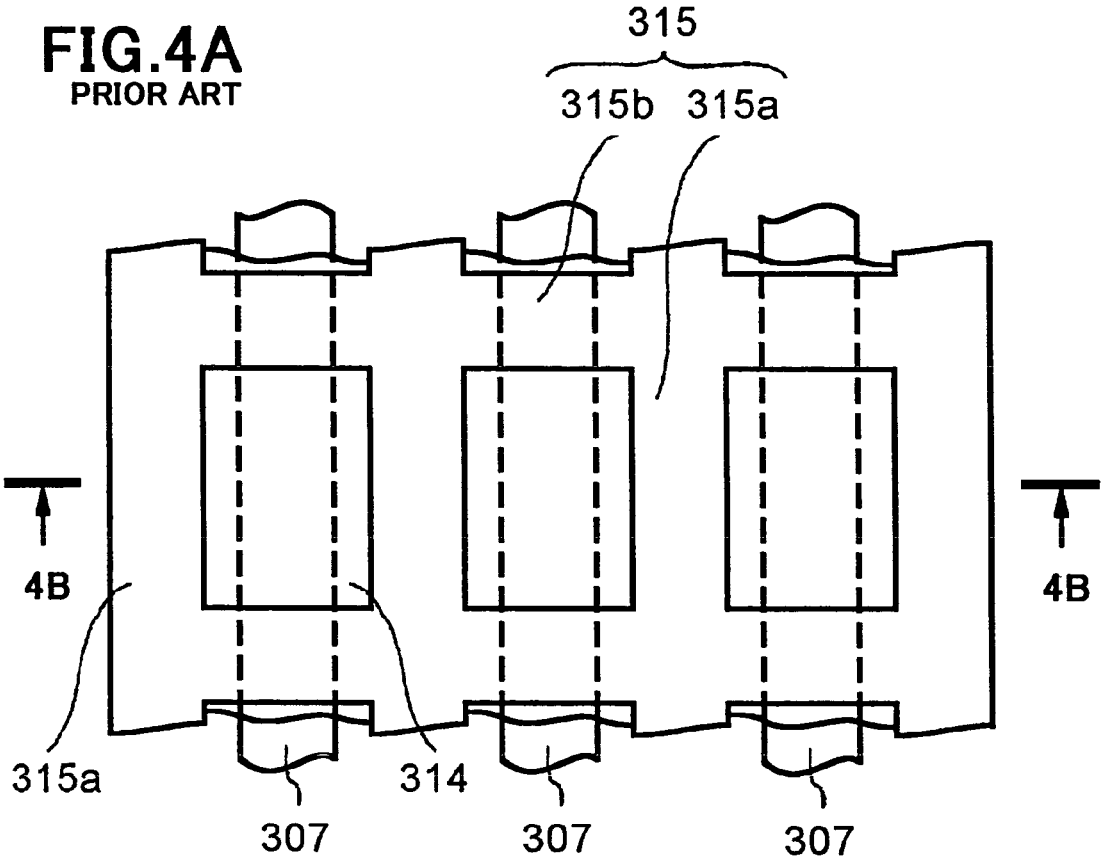
FIG.4A PRIOR ART
FIG. 4A is a plan view of a rear substrate in the plasma display panel illustrated in FIG. 1, showing respective step of a method of fabricating the plasma display panel illustrated in FIG. 1.
Figure 4B:
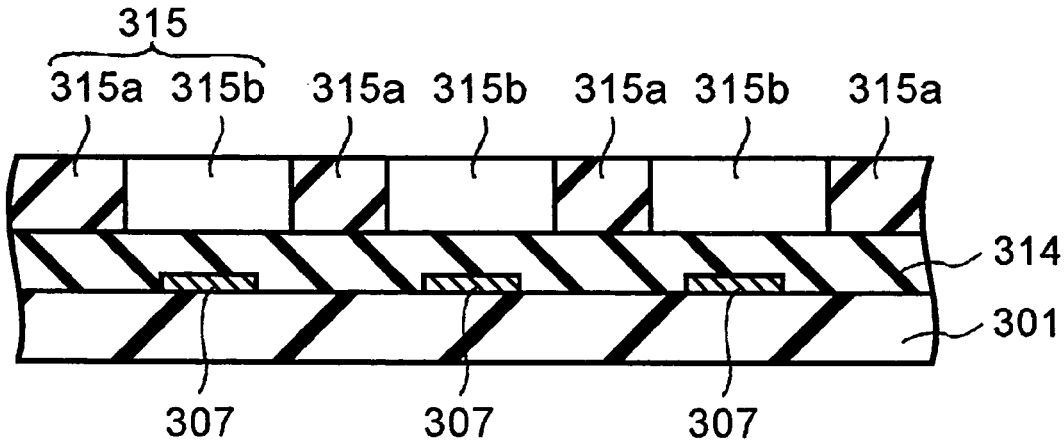
FIG.4B PRIOR ART
FIG. 4B is a cross-sectional view taken along the line 4B—4B in FIG. 4A.
Figure 5A:
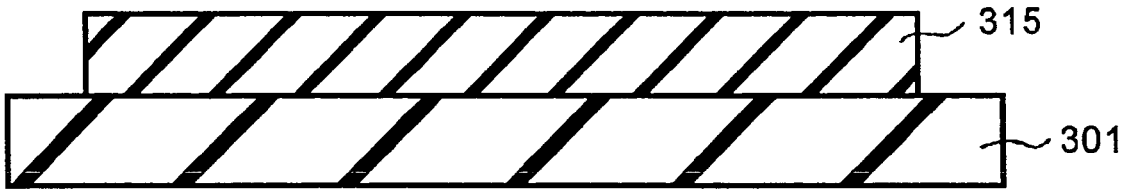
FIG.5A PRIOR ART
FIG. 5A is a cross-sectional view illustrating a partition wall before baked.
Figure 5B:
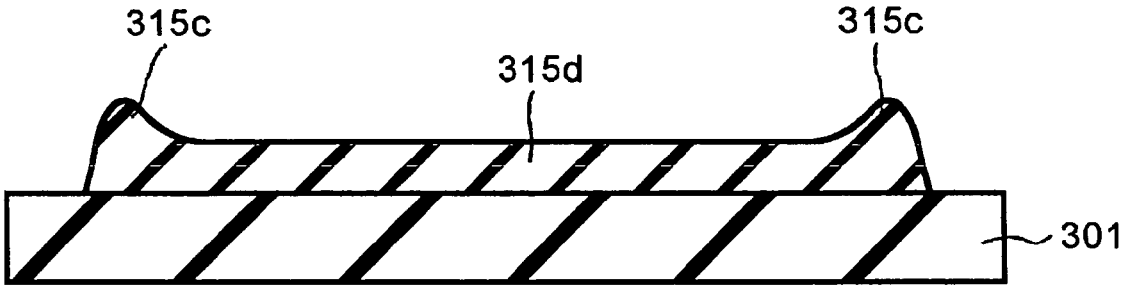
FIG.5B PRIOR ART
FIG. 5B is a cross-sectional view illustrating a partition wall after baked.
Figure 5C:
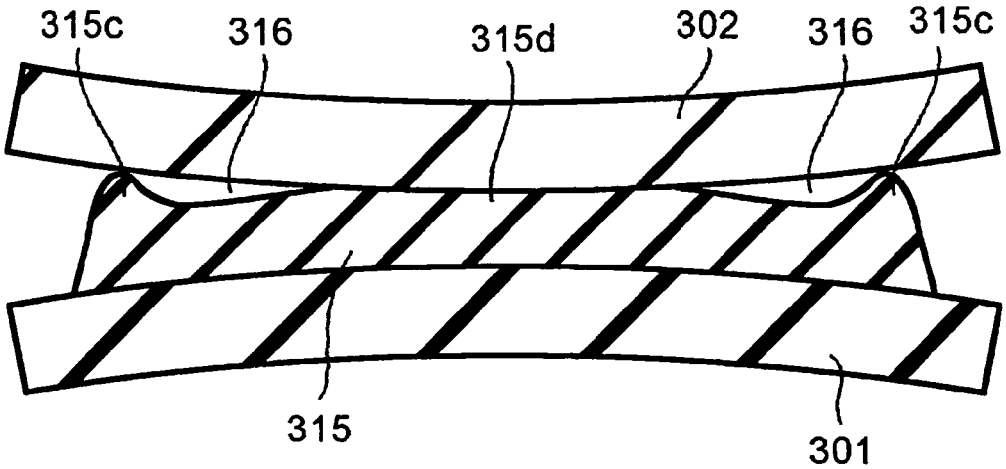
FIG.5C PRIOR ART
FIG. 5C is a cross-sectional view illustrating front and rear substrates aligned to each other.
Figure 8:
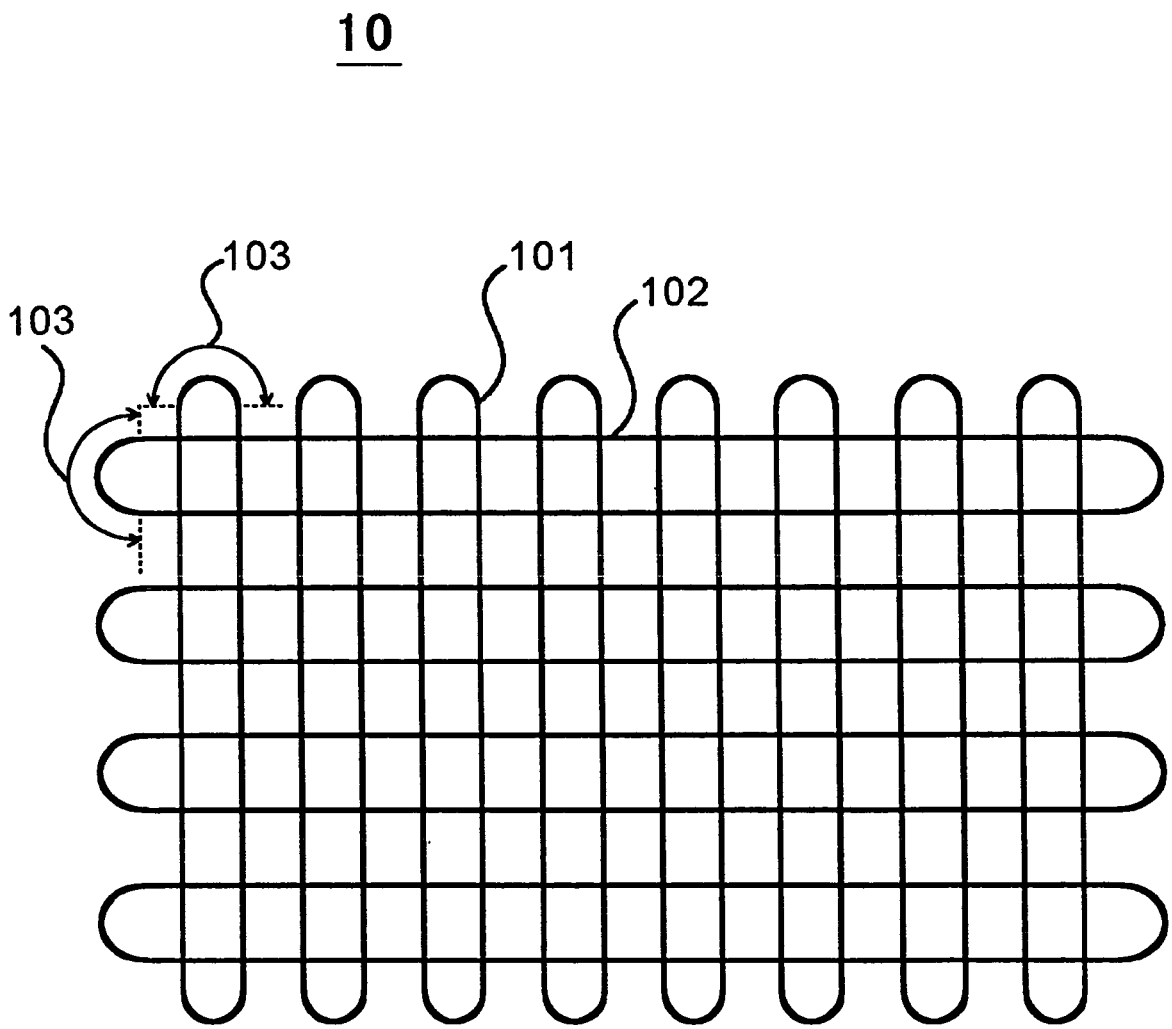
FIG. 8 is a plan view illustrating an outline of a rear substrate in accordance with the first embodiment of the present invention.

FIG. 8 is a plan view illustrating an outline of a rear substrate 10 in accordance with the first embodiment of the present invention. For simplification of FIG. 8, only a partition wall is illustrated in FIG. 8. The rear substrate 10 has the same structure as the rear substrate 352 illustrated in FIG. 1 except a partition wall.

In the rear substrate 10 in accordance with the first embodiment, a partition wall is comprised of a plurality of vertical partition walls 101 extending vertically in FIG. 8 in parallel with one another, and a plurality of horizontal partition walls 102 extending horizontally in FIG. 8 in parallel with one another. The vertical partition walls 101 are equally spaced away from one another, and similarly, the horizontal partition walls 102 are equally spaced away from one another. A ratio of a distance between adjacent horizontal partition walls 102 to a distance between adjacent vertical partition walls 101 is set equal to 3:1. The vertical and horizontal partition walls 101 and 102 are arranged in a grid.

In the rear substrate 10 in accordance with the first embodiment, the vertical partition walls 101 located adjacent to each other are joined at their opposite ends in a length-wise direction to each other through a semi-circular partition wall 103.

Specifically, the rear substrate 10 has sixteen vertical partition walls 101. A N-th vertical partition wall 101 as viewed from the left in FIG. 8 is joined at opposite ends thereof to a (N+1)-th vertical partition wall 101 through the semi-circular partition wall 103. Herein, N indicates a positive odd number in the range of one (1) to fifteen (15).

Similarly, the horizontal partition walls 102 located adjacent to each other are joined at their opposite ends in a length-wise direction to each other through the semi-circular partition wall 103.

Specifically, the rear substrate 10 has eight horizontal partition walls 102. A M-th horizontal partition wall 102 as viewed from the top in FIG. 8 is joined at opposite ends thereof to a (M+1)-th horizontal partition wall 102 through the semi-circular partition wall 103. Herein, M indicates a positive odd number in the range of one (1) to seven (7).

Figures 9A, 9B:
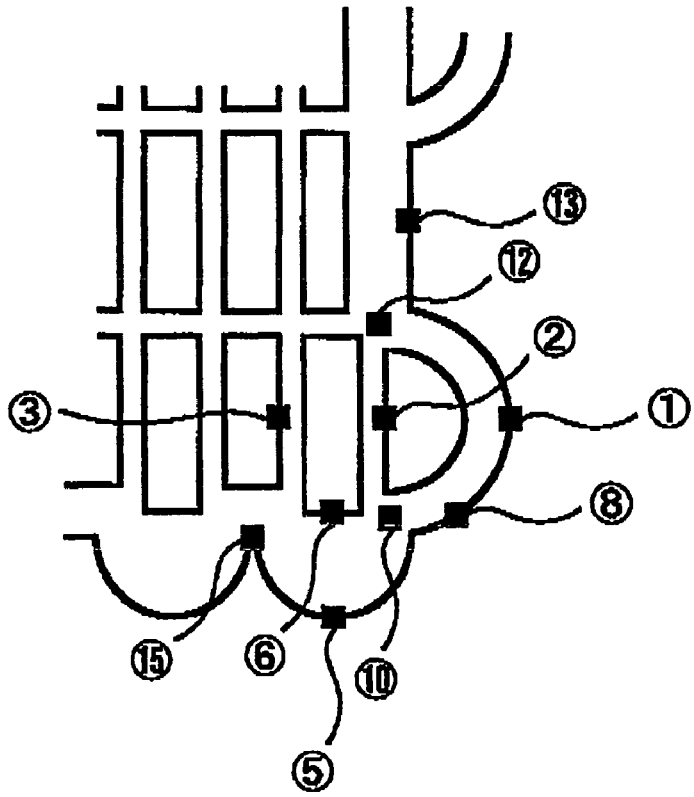
FIG. 9A is a plan view showing points at which a total thickness of a dielectric layer and a partition wall is measured in the rear substrate in accordance with the first embodiment.
FIG. 9B is a table showing the results of measurement.

The inventor had fabricated the rear substrate 10 in accordance with the first embodiment, and measured heights of the vertical partition wall 101, the horizontal partition wall 102 and the semi-circular partition wall 103 at a plurality of points. FIG. 9A shows ten points 1 to 15 at which a total thickness of a dielectric layer and a partition wall is measured in the rear substrate 10, and FIG. 9B is a table showing the results of the measurement.

A designed total thickness of a dielectric layer and a partition wall is 120 micrometers. The highest total thickness is equal to 133 micrometers at point 5, and the second highest total thickness is equal to 132 micrometers at point 1. Considering that measurement error is approximately ±5 micrometers, the total thicknesses measured at points 3, 6, 12 and 15 are within the measurement error, and the maximum gap between the designed total thickness (120 micrometers) and the measured total thickness is 8 micrometers at point 5 among the total thicknesses measured at points 1, 2, 5, 8, 10 and 13 all of which are without the measurement error.

In the partition walls in the conventional plasma display panels suggested in the above-mentioned Japanese Patent Application Publications Nos. 2000-340123 and 11-339668, a gap between a designed total thickness and an actual total thickness is in the range of 20 to 30 micrometers.

As mentioned above, in accordance with the rear substrate 10, the vertical or horizontal partition walls 101 and 102 located adjacent to each other are joined at their opposite ends to each other through the semi-circular partition wall 103, ensuring that contraction force generated during the partition wall is being baked is diffused. Accordingly, it is possible to prevent the vertical and horizontal partition walls 101 and 102 from rising at their ends, and hence, it is also possible to prevent a partition wall from being broken and improperly shaped more surely than the conventional partition walls.

The partition wall in the rear substrate 10 can be formed by varying a pattern of a dry film coated onto a surface of a partition wall paste layer, in accordance with a pattern of the partition wall. Accordingly, the number of steps for fabricating the partition wall in the rear substrate 10 is not increased in comparison with the conventional methods of fabricating a partition wall.

The vertical and horizontal partition walls 101 and 102 are not limited to the above-mentioned ones with respect to a structure. They may be modified as follows.

First, though the vertical and horizontal partition walls 101 and 102 are joined at their opposite ends to each other through the semi-circular partition wall 103 in the rear substrate 10 in accordance with the first embodiment, it is not always necessary to join all of the vertical and horizontal partition walls 101 and 102 to each other.

For instance, only a L-th vertical partition wall 101 and a (L+1)-th vertical partition wall 101 may be joined to each other through the semi-circular partition wall 103, wherein L indicates a positive integer 1, 5, 9 or 13, and the rest of the vertical and horizontal partition walls 101 and 102 may not be joined to each other. That is, it is possible to select the vertical or horizontal partition walls 101 or 102 to be joined to each other through the semi-circular partition wall 103 in accordance with design conditions.

It is preferable that a vertical or horizontal partition wall 101 or 102 located outermost of a display area in a plasma display panel is joined to another vertical or horizontal partition wall 101 or 102 through a semi-circular partition wall 103.

Second, the partition wall 103 through which adjacent vertical or horizontal partition walls 101 or 102 are joined to each other is not to be limited to a semi-circular one.

For instance, the partition wall 103 may be comprised of an arc as a part of a circle or a combination of curves. The partition wall 103 may be comprised of any curves, if the partition wall 103 does not include two lines joined to each other, forming an angle.

Furthermore, the vertical and horizontal partition walls 101 and 102 may be joined to each other only at one of their opposite ends through the semi-circular partition wall 103.

[Second Embodiment]

Figure 10:
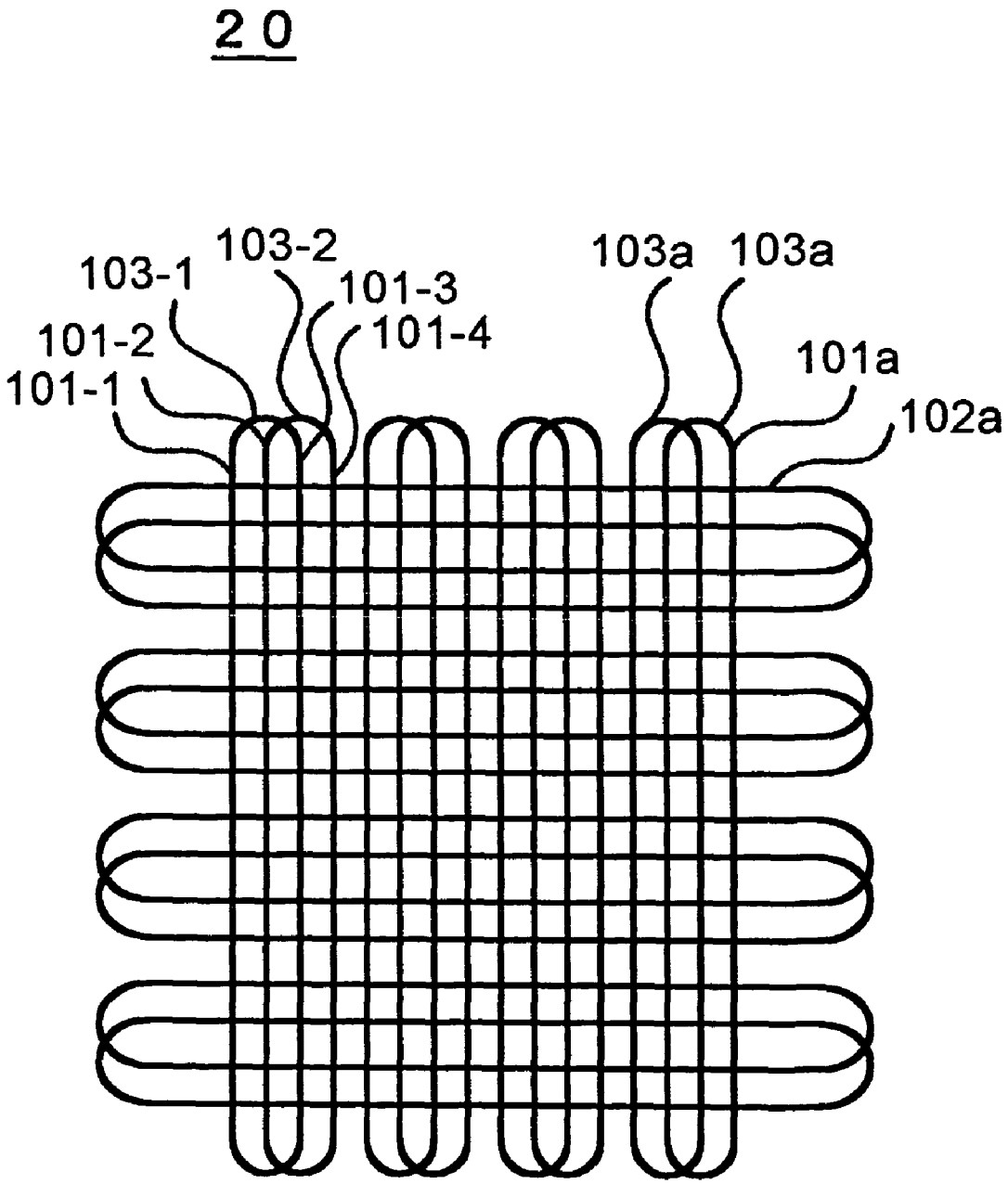
FIG. 10 is a plan view illustrating an outline of a rear substrate in accordance with the second embodiment of the present invention.

FIG. 10 is a plan view illustrating an outline of a rear substrate 20 in accordance with the second embodiment of the present invention. For simplification of FIG. 10, only a partition wall is illustrated in FIG. 10, similarly to FIG. 8. The rear substrate 20 has the same structure as the rear substrate 352 illustrated in FIG. 1 except a partition wall.

In the rear substrate 20 in accordance with the second embodiment, a partition wall is comprised of a plurality of vertical partition walls 101*a* extending vertically in FIG. 10 in parallel with one another, and a plurality of horizontal partition walls 102*a* extending horizontally in FIG. 10 in parallel with one another. The vertical partition walls 101*a* are equally spaced away from one another, and similarly, the horizontal partition walls 102*a* are equally spaced away from one another. A ratio of a distance between adjacent horizontal partition walls 102*a* to a distance between adjacent vertical partition walls 101*a* is set equal to 3:1. The vertical and horizontal partition walls 101*a* and 102*a* are arranged in a grid.

Herein, the four vertical partition walls 101*a* arranged at the left end are called, from the left, a first vertical partition wall 101-1, a second vertical partition wall 101-2, a third vertical partition wall 101-3, and a fourth vertical partition wall 101-4, respectively.

In the second rear substrate 20 in accordance with the second embodiment, the first and third vertical partition walls 101-1 and 101-3 are joined at their opposite ends in a length-wise direction to each other through a first semi-circular partition wall 103-1, and the second and fourth vertical partition walls 101-2 and 101-4 are joined at their opposite ends in a length-wise direction to each other through a second semi-circular partition wall 103-2.

The first and second semi-circular partition walls 103-1 and 103-2 intersect with each other at an immediate point between the second and third vertical partition walls 101-2 and 101-3.

A distance between the first and third vertical partition walls 101-1 and 101-3 is equal to a distance between the second and fourth vertical partition walls 101-2 and 101-4. Hence, the first semi-circular partition wall 103-1 is equal in radius to the second semi-circular partition wall 103-2.

Specifically, the rear substrate 20 includes sixteen vertical partition walls 101*a*. A vertical partition wall 101*a* located at N-th from the left in FIG. 10 is joined at their opposite ends to a vertical partition wall 101*a* located at (N+2)-th through the semi-circular partition wall 103-1, and a vertical partition wall 101*a* located at M-th from the left in FIG. 10 is joined at their opposite ends to a vertical partition wall 101*a* located at (M+2)-th through the semi-circular partition wall 103-2, wherein N indicates a positive odd number 1, 5, 9 or 13, and M indicates a positive even number 2, 6, 10 or 14.

The horizontal partition walls 102*a* are arranged in the same way as the vertical partition walls 101*a*.

Figures 11A, 11B:
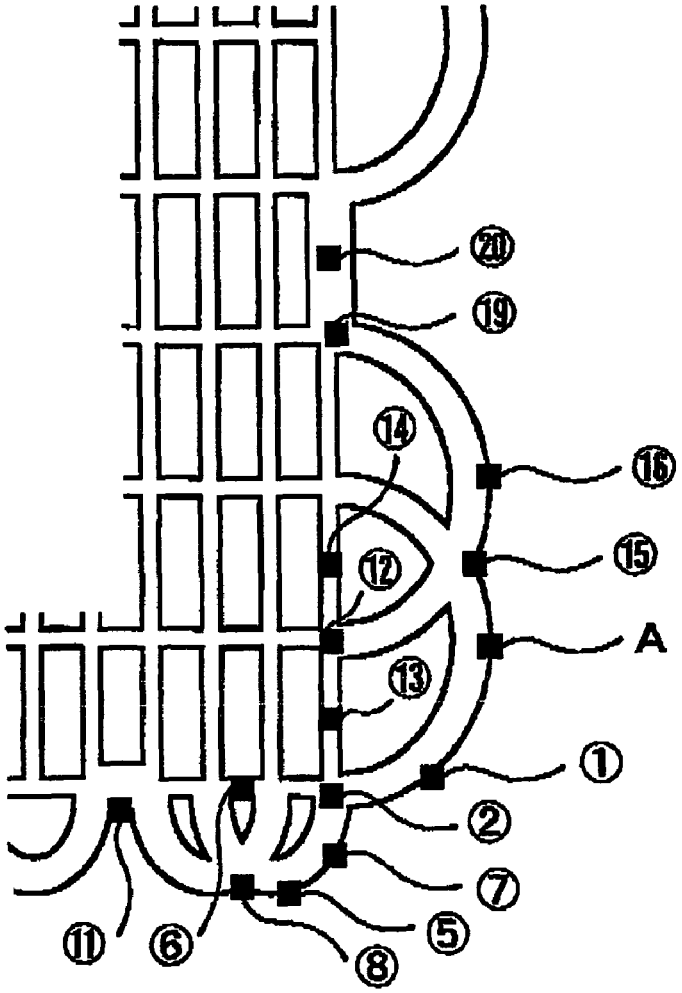
FIG. 11A is a plan view showing points at which a total thickness of a dielectric layer and a partition wall is measured in the rear substrate in accordance with the second embodiment.
FIG. 11B is a table showing the results of measurement.

The inventor had fabricated the rear substrate 20 in accordance with the second embodiment, and measured heights of the vertical partition wall 101*a,* the horizontal partition wall 102*a* and the semi-circular partition wall 103*a* at a plurality of points. FIG. 11A shows fifteen points 1 to 20 and A at which a total thickness of a dielectric layer and a partition wall is measured in the rear substrate 20, and FIG. 11B is a table showing the results of the measurement.

A designed total thickness of a dielectric layer and a partition wall is 120 micrometers. The highest total thickness is equal to 138 micrometers at point 8, and the second highest total thickness is equal to 134 micrometers at point 5. Considering that measurement error is approximately ±5 micrometers, the total thicknesses measured at points 2, 6, 11, 12, 14, 15, 16, 19 and A are within the measurement error, and the maximum gap between the designed total thickness (120 micrometers) and the measured total thickness is 9 micrometers at point 5 among the total thicknesses measured at points 1, 5, 7, 8, 13 and 20 all of which are without the measurement error.

In the partition walls in the conventional plasma display panels suggested in the above-mentioned Japanese Patent Application Publications Nos. 2000-340123 and 11-339668, a gap between a designed total thickness and an actual total thickness is in the range of 20 to 30 micrometers.

As mentioned above, in accordance with the rear substrate 20, a pair of the vertical or horizontal partition walls 101*a* and 102*a* is joined at their opposite ends to each other through the semi-circular partition wall 103*a,* ensuring that contraction force generated during the partition wall is being baked is diffused. Accordingly, it is possible to prevent the vertical and horizontal partition walls 101*a* and 102*a* from rising at their ends, and hence, it is also possible to prevent a partition wall from being broken and improperly shaped more surely than the conventional partition walls, similarly to the rear substrate 10 in accordance with the first embodiment.

Various modifications may be applied to the vertical partition walls 101*a,* the horizontal partition walls 102*a* and the partition walls 103*a* in the rear substrate 20, similarly to the rear substrate 10.

[Third Embodiment]

Figure 12:
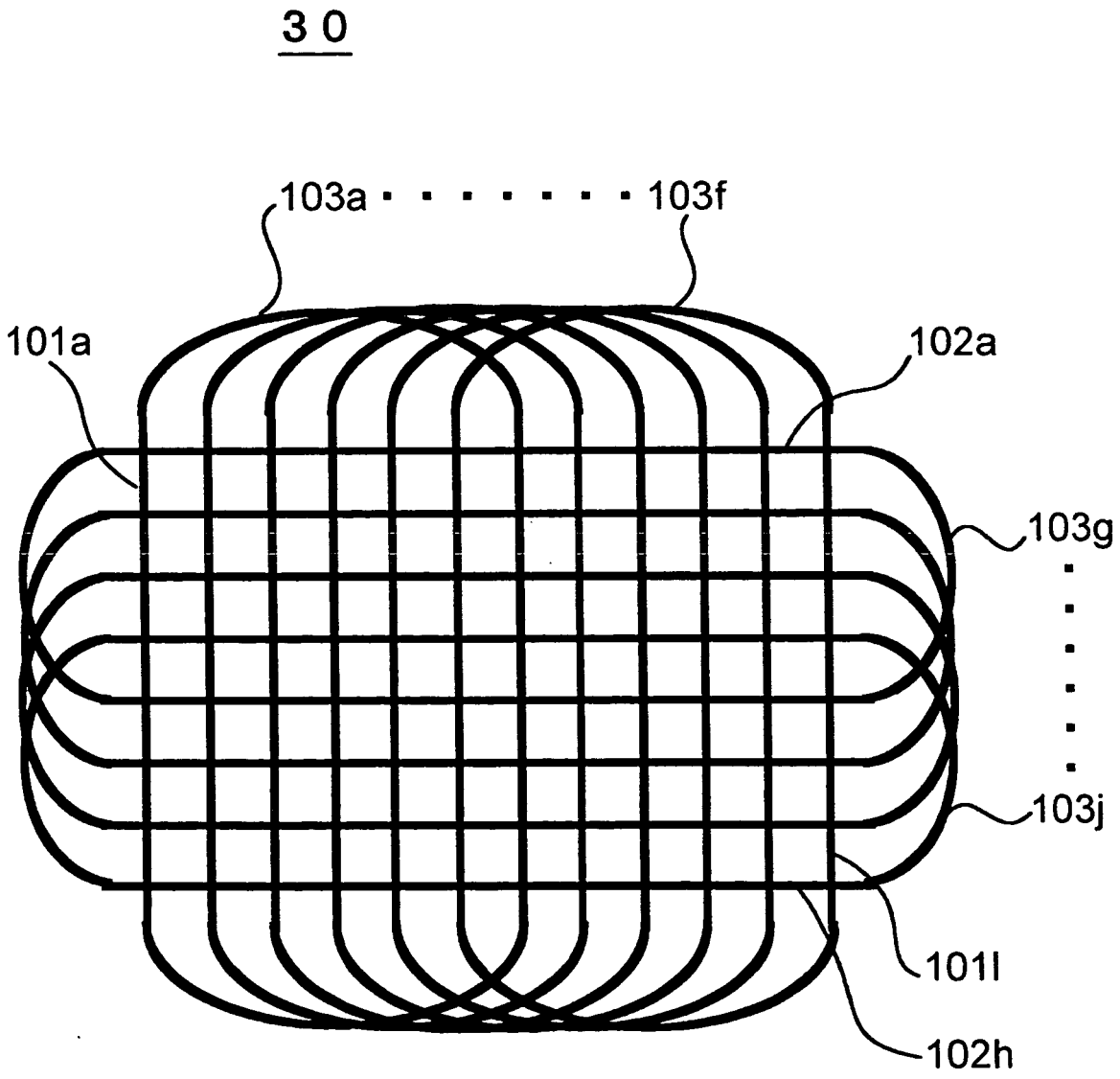
FIG. 12 is a plan view illustrating an outline of a rear substrate in accordance with the third embodiment of the present invention.

FIG. 12 is a plan view illustrating an outline of a rear substrate 30 in accordance with the third embodiment of the present invention. For simplification of FIG. 12, only a partition wall is illustrated in FIG. 12, similarly to FIG. 8. The rear substrate 30 has the same structure as the rear substrate 352 illustrated in FIG. 1 except a partition wall.

In the rear substrate 30 in accordance with the third embodiment, a partition wall is comprised of twelve vertical partition walls 101*a* to 101*l* extending vertically in FIG. 12 in parallel with one another, and eight horizontal partition walls 102*a* to 102*h* extending horizontally in FIG. 12 in parallel with one another. The vertical partition walls 101*a* to 101*l* are equally spaced away from one another, and similarly, the horizontal partition walls 102*a* to 102*h* are equally spaced away from one another. A ratio of a distance between adjacent horizontal partition walls 102*a* to 102*h* to a distance between adjacent vertical partition walls 101*a* to 101*l* is set equal to 3:1. The vertical and horizontal partition walls 101*a* to 101*l* and 102*a* to 102*h* are arranged in a grid.

In the rear substrate 30, the vertical partition walls 101*a* to 101*l* located every five rows are joined at their opposite ends thereof to each other through a semi-circular partition wall.

Specifically, the first and seventh vertical partition walls 101*a* and 101*g* are joined at their opposite ends in a length-wise direction to each other through a semi-circular partition wall 103*a*. Similarly, the second and eighth vertical partition walls 101*b* and 101*h* are joined at their opposite ends in a length-wise direction to each other through a semi-circular partition wall 103*b,* the third and ninth vertical partition walls 101*c* and 101*i* are joined at their opposite ends in a length-wise direction to each other through a semi-circular partition wall 103*c,* the fourth and tenth vertical partition walls 101*d* and 101*j* are joined at their opposite ends in a length-wise direction to each other through a semi-circular partition wall 103*d,* the fifth and eleventh vertical partition walls 101*e* and 101*k* are joined at their opposite ends in a length-wise direction to each other through a semi-circular partition wall 103*e,* and the sixth and twelfth vertical partition walls 101*f* and 101*l* are joined at their opposite ends in a length-wise direction to each other through a semi-circular partition wall 103*f*.

The horizontal partition walls 102*a* to 102*h* located every three rows are joined at their opposite ends thereof to each other through a semi-circular partition wall.

Specifically, the first and fifth horizontal partition walls 102*a* and 102*e* are joined at their opposite ends in a length-wise direction to each other through a semi-circular partition wall 103*g*. Similarly, the second and sixth horizontal partition walls 102*b* and 102*f* are joined at their opposite ends in a length-wise direction to each other through a semi-circular partition wall 103*h,* the third and seventh horizontal partition walls 102*c* and 102*g* are joined at their opposite ends in a length-wise direction to each other through a semi-circular partition wall 103*i,* and the fourth and eighth horizontal partition walls 102*d* and 102*h* are joined at their opposite ends in a length-wise direction to each other through a semi-circular partition wall 103*j*.

That is, the vertical partition walls 101*a* to 101*l* located every S/2 rows are joined at their opposite ends thereof to each other through a semi-circular partition wall, wherein S indicates a total number of vertical partition walls. Similarly, the horizontal partition walls 102*a* to 102*h* located every S/2 rows are joined at their opposite ends thereof to each other through a semi-circular partition wall, wherein S indicates a total number of horizontal partition walls.

As mentioned above, in accordance with the rear substrate 30, a pair of the vertical or horizontal partition walls 101*a* to 101*l* or 102*a* to 102*h* is joined at their opposite ends to each other through the semi-circular partition wall 103*a* to 103*f* or 103*g* to 103*j,* ensuring that contraction force generated during the partition wall is being baked is diffused. Accordingly, it is possible to prevent the vertical and horizontal partition walls from rising at their ends, and hence, it is also possible to prevent a partition wall from being broken and improperly shaped more surely than the conventional partition walls, similarly to the rear substrates 10 and 20 in accordance with the first and second embodiments.

[Fourth Embodiment]

Figure 13:
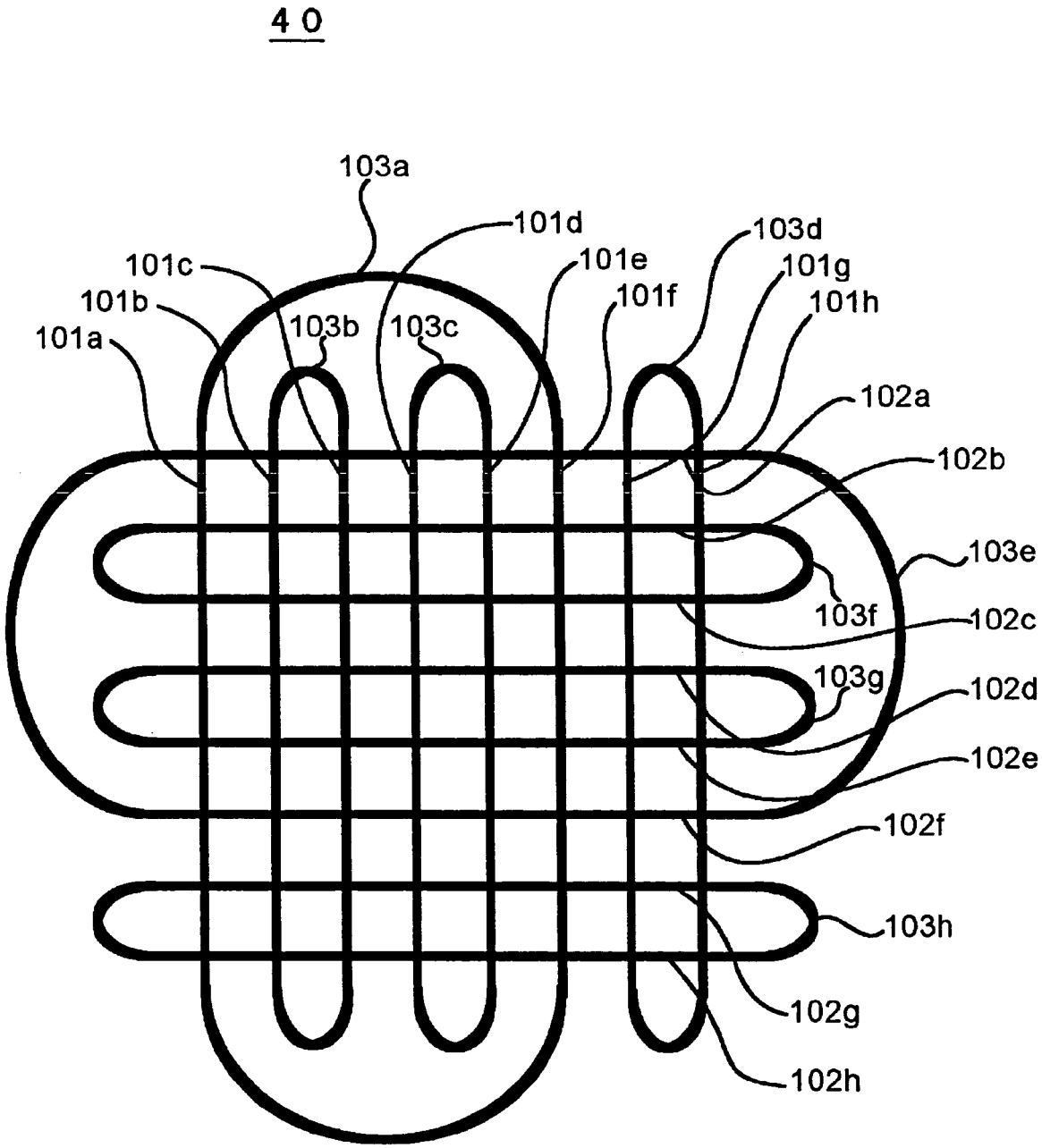
FIG. 13 is a plan view illustrating an outline of a rear substrate in accordance with the fourth embodiment of the present invention.

FIG. 13 is a plan view illustrating an outline of a rear substrate 40 in accordance with the fourth embodiment of the present invention. For simplification of FIG. 13, only a partition wall is illustrated in FIG. 13, similarly to FIG. 8. The rear substrate 40 has the same structure as the rear substrate 352 illustrated in FIG. 1 except a partition wall.

In the rear substrate 40 in accordance with the fourth embodiment, a partition wall is comprised of eighth vertical partition walls 101*a* to 101*h* extending vertically in FIG. 13 in parallel with one another, and eight horizontal partition walls 102*a* to 102*h* extending horizontally in FIG. 13 in parallel with one another. The vertical partition walls 101*a* to 101*h* are equally spaced away from one another, and similarly, the horizontal partition walls 102*a* to 102*h* are equally spaced away from one another. A ratio of a distance between adjacent horizontal partition walls 102*a* to 102*h* to a distance between adjacent vertical partition walls 101*a* to 101*h* is set equal to 3:1. The vertical and horizontal partition walls 101*a* to 101*h* and 102*a* to 102*h* are arranged in a grid.

In the substrate 40, a first pair of partition walls is joined at their opposite ends thereof to each other through a semi-circular partition wall, and second and third pairs of partition walls are arranged inside the first pair of partition walls. Each of the second and third pairs of partition walls is joined at their opposite ends thereof to each other through a semi-circular partition wall.

Specifically, the first and sixth vertical partition walls 101*a* and 101*f* are joined at their opposite ends in a length-wise direction to each other through a semi-circular partition wall 103*a*. The second and third vertical partition walls 101*b* and 101*c* both surrounded by the first and sixth vertical partition walls 101*a* and 101*f* are joined at their opposite ends in a length-wise direction to each other through a semi-circular partition wall 103*b*, and the fourth and fifth vertical partition walls 101*d* and 101*e* both surrounded by the first and sixth vertical partition walls 101*a* and 101*f* are joined at their opposite ends in a length-wise direction to each other through a semi-circular partition wall 103*c*.

The semi-circular partition wall 103*a* has a radius five times greater than radiuses of the semi-circular partition walls 103*b* and 103*c*. The semi-circular partition wall 103*b* has a radius equal to a radius of the semi-circular partition walls 103*c*.

Similarly, the first and sixth horizontal partition walls 102*a* and 102*f* are joined at their opposite ends in a length-wise direction to each other through a semi-circular partition wall 103*e*. The second and third horizontal partition walls 102*b* and 102*c* both surrounded by the first and sixth horizontal partition walls 102*a* and 102*f* are joined at their opposite ends in a length-wise direction to each other through a semi-circular partition wall 103*f*, and the fourth and fifth horizontal partition walls 102*d* and 102*e* both surrounded by the first and sixth horizontal partition walls 102*a* and 102*f* are joined at their opposite ends in a length-wise direction to each other through a semi-circular partition wall 103*g*.

The semi-circular partition wall 103*e* has a radius five times greater than radiuses of the semi-circular partition walls 103*f* and 103*g*. The semi-circular partition wall 103*f* has a radius equal to a radius of the semi-circular partition walls 103*g*.

The seventh and eighth vertical partition walls 101*g* and 101*h* are joined at their opposite ends in a length-wise direction to each other through a semi-circular partition wall 103*d*, and the seventh and eighth horizontal partition walls 102*g* and 102*h* are joined at their opposite ends in a length-wise direction to each other through a semi-circular partition wall 103*h*. The seventh and eighth vertical partition walls 101*g* and 101*h* are located outside the semi-circular partition wall 103*a*, and the seventh and eighth horizontal partition walls 102*g* and 102*h* are located outside the semi-circular partition wall 103*e*.

In the rear substrate 40 in accordance with the fourth embodiment, two pairs of vertical partition walls, that is, a pair of the second and third vertical partition walls 101*b* and 101*c* and a pair of the fourth and fifth vertical partition walls 101*d* and 101*e* are arranged inside the first and sixth vertical partition walls 101*a* and 101*f* and the semi-circular partition walls 103*a*. However, the number of pairs of vertical partition walls arranged inside of the first and sixth vertical partition walls 101*a* and 101*f* and the semi-circular partition walls 103*a* is not to be limited to two. Any number may be selected. The same is applied to the horizontal partition wall.

As mentioned above, in accordance with the rear substrate 40, a pair of the vertical or horizontal partition walls is joined at their opposite ends to each other through the semi-circular partition walls, ensuring that contraction force generated during the partition wall is being baked is diffused. Accordingly, it is possible to prevent the vertical and horizontal partition walls from rising at their ends, and hence, it is also possible to prevent a partition wall from being broken and improperly shaped more surely than the conventional partition walls, similarly to the rear substrates 10 and 20 in accordance with the first and second embodiments.

[Fifth Embodiment]

Figure 14:
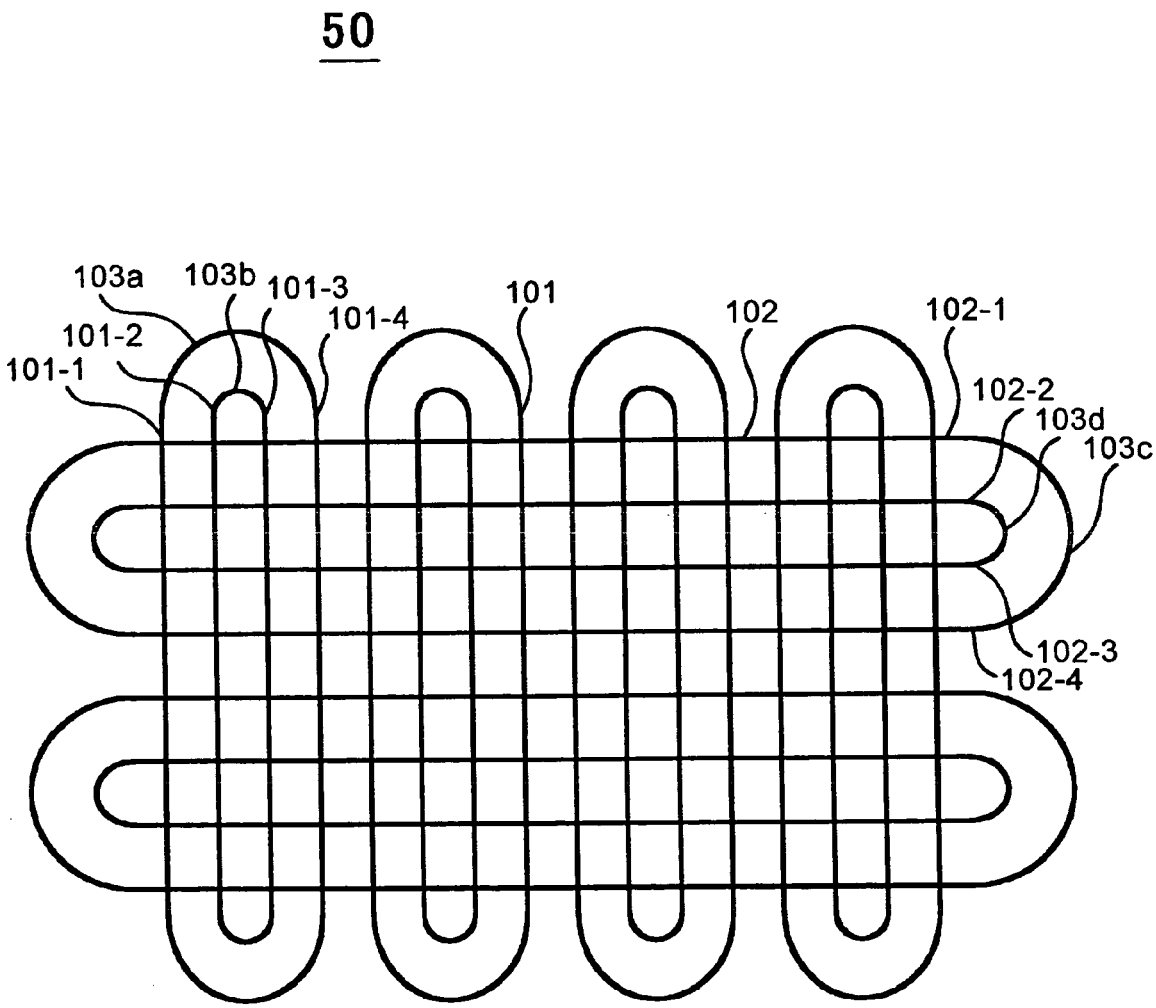
FIG. 14 is a plan view illustrating an outline of a rear substrate in accordance with the fifth embodiment of the present invention.

FIG. 14 is a plan view illustrating an outline of a rear substrate 50 in accordance with the fifth embodiment of the present invention. For simplification of FIG. 14, only a partition wall is illustrated in FIG. 14, similarly to FIG. 8. The rear substrate 50 has the same structure as the rear substrate 352 illustrated in FIG. 1 except a partition wall.

In the rear substrate 50 in accordance with the fifth embodiment, a partition wall is comprised of a plurality of vertical partition walls 101 extending vertically in FIG. 14 in parallel with one another, and a plurality of horizontal partition walls 102 extending horizontally in FIG. 14 in parallel with one another. The vertical partition walls 101 are equally spaced away from one another, and similarly, the horizontal partition walls 102 are equally spaced away from one another. A ratio of a distance between adjacent horizontal partition walls 102 to a distance between adjacent vertical partition walls 101 is set equal to 3:1. The vertical and horizontal partition walls 101 and 102 are arranged in a grid.

Herein, the four vertical partition walls 101 arranged at the left end are called, from the left, a first vertical partition wall 101-1, a second vertical partition wall 101-2, a third vertical partition wall 101-3, and a fourth vertical partition wall 101-4, respectively.

In the rear substrate 50 in accordance with the fifth embodiment, the first and fourth vertical partition walls 101-1 and 101-4 are joined at their opposite ends in a length-wise direction to each other through first semi-circular partition walls 103*a*, and the second and third vertical partition walls 101-2 and 101-3 are joined at their opposite ends in a length-wise direction to each other through second semi-circular partition walls 103*b*.

The first semi-circular partition wall 103*a* has a radius three times greater than a radius of the second semi-circular partition wall 103*b*.

In the rear substrate 50, a first pair of the vertical partition walls 101-1 and 101-4 is joined at their opposite ends thereof to each other through the first semi-circular partition walls 103*a,* and a second pair of the vertical partition walls 101-2 and 101-3 are arranged inside the first pair of vertical partition walls 101-1 and 101-4. The second pair of the vertical partition walls 101-2 and 101-3 is joined at their opposite ends thereof to each other through the second semi-circular partition wall 103*b*.

The partition wall configuration as mentioned above is repeated every four vertical partition walls 101.

The horizontal partition walls 102 are arranged in the same way as the vertical partition walls 101.

Herein, the four horizontal partition walls 102 arranged at the top end are called, from the top, a first horizontal partition wall 102-1, a second horizontal partition wall 102-2, a third horizontal partition wall 102-3, and a fourth horizontal partition wall 102-4, respectively.

In the rear substrate 50, a first pair of the horizontal partition walls 102-1 and 102-4 is joined at their opposite ends thereof to each other through the first semi-circular partition walls 103*c,* and a second pair of the horizontal partition walls 102-2 and 102-3 are arranged inside the first pair of horizontal partition walls 102-1 and 102-4. The second pair of the horizontal partition walls 102-2 and 102-3 is joined at their opposite ends thereof to each other through the second semi-circular partition wall 103*d.*

The semi-circular partition wall 103*c* has a radius three times greater than a radius of the semi-circular partition wall 103*d.*

In the rear substrate 50, a first pair of the horizontal partition walls 102-1 and 102-4 is joined at their opposite ends thereof to each other through the semi-circular partition walls 103*c,* and a second pair of the horizontal partition walls 102-2 and 102-3 are arranged inside the first pair of horizontal partition walls 102-1 and 102-4. The second pair of the horizontal partition walls 102-2 and 102-3 is joined at their opposite ends thereof to each other through the semi-circular partition wall 103*d.*

The partition wall configuration as mentioned above is repeated every four horizontal partition walls 102.

Figures 15A, 15B:
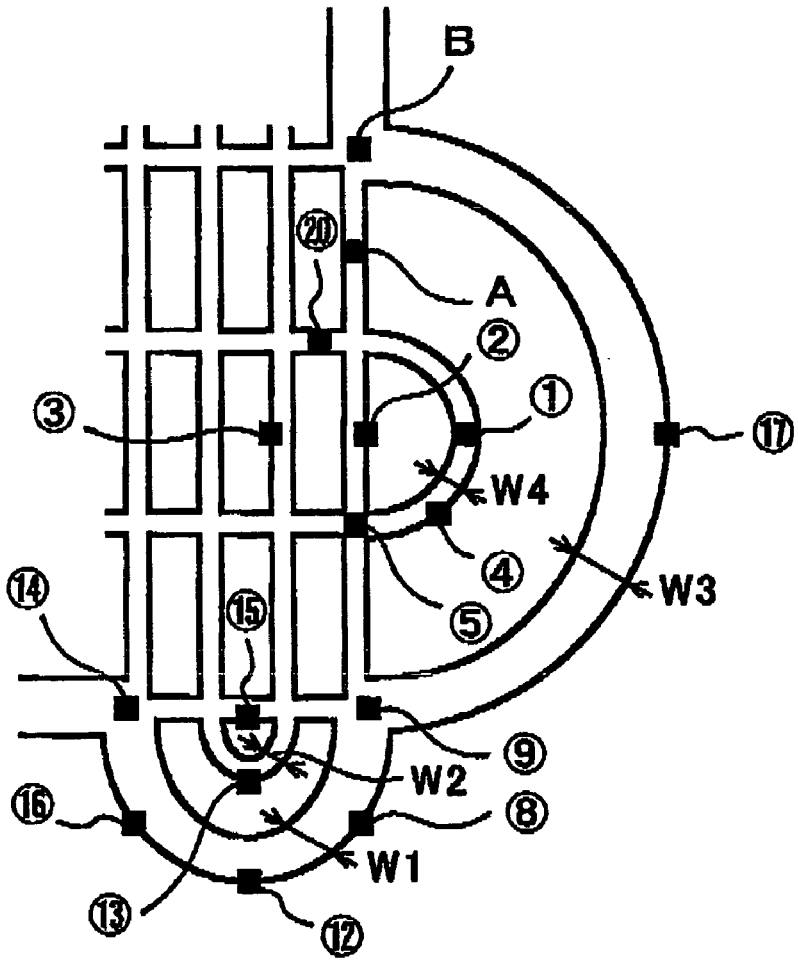
FIG. 15A is a plan view showing points at which a total thickness of a dielectric layer and a partition wall is measured in the rear substrate in accordance with the fifth embodiment.
FIG. 15B is a table showing the results of measurement.

The inventor had fabricated the rear substrate 50 in accordance with the fifth embodiment, and measured heights of the vertical partition wall 101, the horizontal partition wall 102 and the semi-circular partition wall 103 at a plurality of points. FIG. 15A shows sixteen points 1 to 20, A and B at which a total thickness of a dielectric layer and a partition wall is measured in the rear substrate 50, and FIG. 15B is a table showing the results of the measurement.

A designed total thickness of a dielectric layer and a partition wall is 120 micrometers. The highest total thickness is equal to 136 micrometers at point 13, and the second highest total thickness is equal to 131 micrometers at point 1. Considering that measurement error is approximately ±5 micrometers, the total thicknesses measured at points 2, 3, 5, 9, 14, 20 and B are within the measurement error, and the maximum gap between the designed total thickness (120 micrometers) and the measured total thickness is 11 micrometers at point 13 among the total thicknesses measured at points 1, 4, 8, 12, 13, 15, 16, 17 and A all of which are without the measurement error.

In the partition walls in the conventional plasma display panels suggested in the above-mentioned Japanese Patent Application Publications Nos. 2000-340123 and 11-339668, a gap between a designed total thickness and an actual total thickness is in the range of 20 to 30 micrometers.

As mentioned above, in accordance with the rear substrate 50, a pair of the vertical or horizontal partition walls is joined at their opposite ends to each other through the semi-circular partition wall, ensuring that contraction force generated during the partition wall is being baked is diffused. Accordingly, it is possible to prevent the vertical and horizontal partition walls from rising at their ends, and hence, it is also possible to prevent a partition wall from being broken and improperly shaped more surely than the conventional partition walls.

Various modifications may be applied to the vertical partition walls 101, the horizontal partition walls 102 and the partition walls 103 in the rear substrate 50, similarly to the rear substrate 10.

A partition wall located outside is likely to be side-etched during sand blasting in comparison with a partition wall located inside. Accordingly, as illustrated in FIG. 15A, the semi-circular partition wall 103*a* is designed to have a width W1 greater than a width W2 of the semi-circular partition wall 103*b,* and, the semi-circular partition wall 103*c* is designed to have a width W3 greater than a width W4 of the semi-circular partition wall 103*d.*

Furthermore, since the semi-circular partition walls 103*a* and 103*c* located outside can have a curvature greater than a curvature of the semi-circular partition walls 103*b* and 103*d* located inside, the vertical or horizontal partition walls joined to each other through the semi-circular partition walls 103*a* and 103*c* can diffuse contraction forces exerted thereon to a much degree, preventing them from rising at their opposite ends.

In the rear substrate 50 in accordance with the fifth embodiment, the pair of the vertical or horizontal partition walls joined at their opposite ends thereof to each other through the semi-circular partition wall is arranged in another pair of the vertical or horizontal partition walls joined at their opposite ends thereof to each other through the semi-circular partition walls. As a modification of the fifth embodiment, a structure where a pair of the vertical or horizontal partition walls joined at their opposite ends thereof to each other through the semi-circular partition wall is arranged in another pair of the vertical or horizontal partition walls joined at their opposite ends thereof to each other through the semi-circular partition walls may be repeated N times, wherein N is a positive integer equal to or greater than two (2).

Hereinbelow is shown an example in which three pairs of vertical or horizontal partition walls are arranged similarly to and coaxially with one another, as the sixth embodiment.

[Sixth Embodiment]

Figure 16:
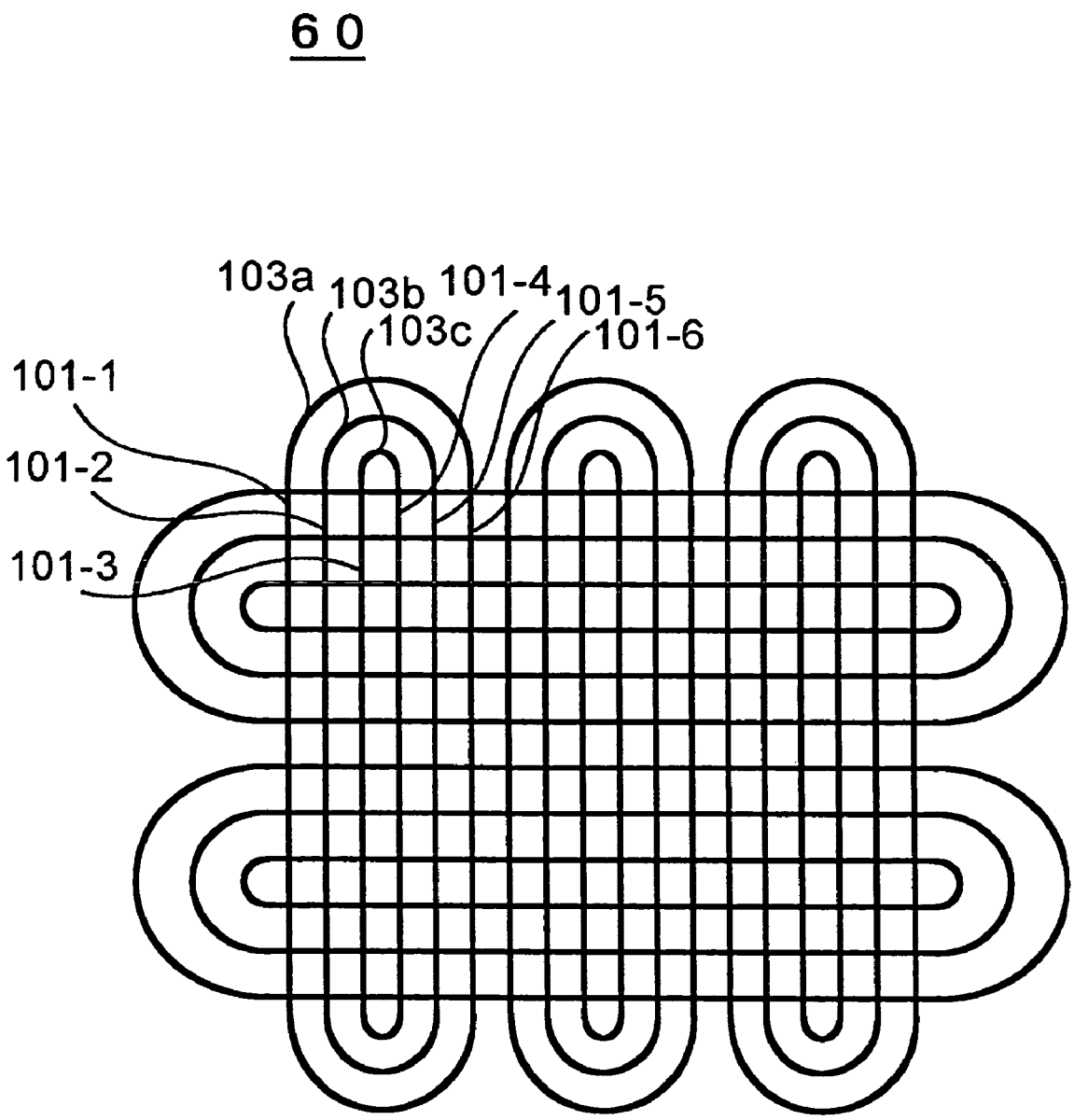
FIG. 16 is a plan view illustrating an outline of a rear substrate in accordance with the sixth embodiment of the present invention.

FIG. 16 is a plan view illustrating an outline of a rear substrate 60 in accordance with the sixth embodiment of the present invention. For simplification of FIG. 16, only a partition wall is illustrated in FIG. 16, similarly to FIG. 8. The rear substrate 60 has the same structure as the rear substrate 352 illustrated in FIG. 1 except a partition wall.

In the rear substrate 60 in accordance with the sixth embodiment, a partition wall is comprised of a plurality of vertical partition walls 101 extending vertically in FIG. 16 in parallel with one another, and a plurality of horizontal partition walls 102 extending horizontally in FIG. 16 in parallel with one another. The vertical partition walls 101 are equally spaced away from one another, and similarly, the horizontal partition walls 102 are equally spaced away from one another. A ratio of a distance between adjacent horizontal partition walls 102 to a distance between adjacent vertical partition walls 101 is set equal to 3:1. The vertical and horizontal partition walls 101 and 102 are arranged in a grid.

Herein, the six vertical partition walls 101 arranged at the left end are called, from the left, a first vertical partition wall

101-1, a second vertical partition wall 101-2, a third vertical partition wall 101-3, a fourth vertical partition wall 101-4, a fifth vertical partition wall 101-5, and a sixth vertical partition wall 101-6, respectively.

In the rear substrate 60 in accordance with the sixth embodiment, the first and sixth vertical partition walls 101-1 and 101-6 are joined at their opposite ends in a length-wise direction to each other through first semi-circular partition walls 103*a,* the second and fifth vertical partition walls 101-2 and 101-5 are joined at their opposite ends in a length-wise direction to each other through second semi-circular partition walls 103*b,* and the third and fourth vertical partition walls 101-3 and 101-4 are joined at their opposite ends in a length-wise direction to each other through third semi-circular partition walls 103*c.*

The first semi-circular partition wall 103*a* has a radius five times greater than a radius of the third semi-circular partition wall 103*c,* and the second semi-circular partition wall 103*b* has a radius three times greater than a radius of the third semi-circular partition wall 103*c.*

In the rear substrate 60, a first pair of the vertical partition walls 101-1 and 101-6 is joined at their opposite ends thereof to each other through the first semi-circular partition walls 103*a,* a second pair of the vertical partition walls 101-2 and 101-5 are arranged inside the first pair of vertical partition walls 101-1 and 101-6, and is joined at their opposite ends thereof to each other through the second semi-circular partition wall 103*b,* and further, a third pair of the vertical partition walls 101-3 and 101-4 are arranged inside the second pair of vertical partition walls 101-2 and 101-5, and is joined at their opposite ends thereof to each other through the third semi-circular partition wall 103*c.*

The partition wall configuration as mentioned above is repeated every six vertical partition walls 101.

The horizontal partition walls 102 are arranged in the same way as the vertical partition walls 101.

Figures 17A, 17B:
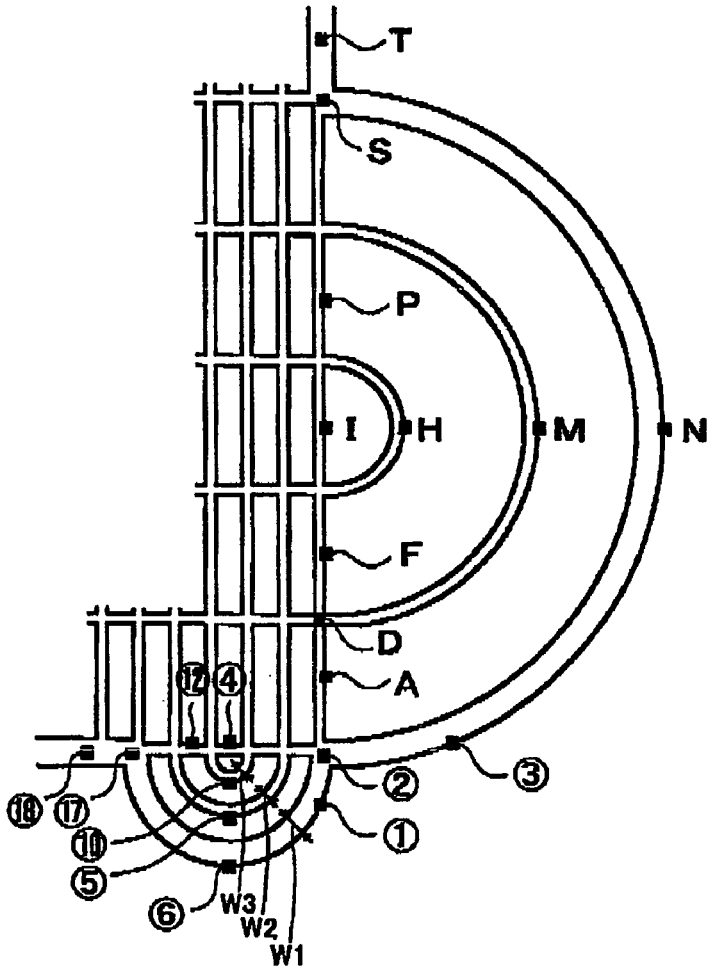
FIG. 17A is a plan view showing points at which a total thickness of a dielectric layer and a partition wall is measured in the rear substrate in accordance with the sixth embodiment.
FIG. 17B is a table showing the results of measurement.

The inventor had fabricated the rear substrate 60 in accordance with the sixth embodiment, and measured heights of the vertical partition wall, the horizontal partition wall and the semi-circular partition wall at a plurality of points. FIG. 17A shows twenty points 1 to 18 and A to T at which a total thickness of a dielectric layer and a partition wall is measured in the rear substrate 60, and FIG. 17B is a table showing the results of the measurement.

A designed total thickness of a dielectric layer and a partition wall is 120 micrometers. The highest total thickness is equal to 133 micrometers at points 1, 3, 6 and 10, and the second highest total thickness is equal to 131 micrometers at point A. Considering that measurement error is approximately ±5 micrometers, the total thicknesses measured at points 2, 4, 12, 17, 18, P and S are within the measurement error, and the maximum gap between the designed total thickness (120 micrometers) and the measured total thickness is 8 micrometers at points 1, 3, 6 and 10 among the total thicknesses measured at points 1, 3, 5, 6, 10, A, D, F, H, I, M, N and T all of which are without the measurement error.

In the partition walls in the conventional plasma display panels suggested in the above-mentioned Japanese Patent Application Publications Nos. 2000-340123 and 11-339668, a gap between a designed total thickness and an actual total thickness is in the range of 20 to 30 micrometers.

As mentioned above, in accordance with the rear substrate 60, a pair of the vertical or horizontal partition walls is joined at their opposite ends to each other through the semi-circular partition wall, ensuring that contraction force generated during the partition wall is being baked is diffused. Accordingly, it is possible to prevent the vertical and horizontal partition walls from rising at their ends, and hence, it is also possible to prevent a partition wall from being broken and improperly shaped more surely than the conventional partition walls.

As illustrated in FIG. 17A, the semi-circular partition wall 103*a* is designed to have a width W1 greater than a width W2 of the semi-circular partition wall 103*b,* and the semi-circular partition wall 103*b* is designed to have a width W2 greater than a width W3 of the semi-circular partition wall 103*c.*

With respect to a width of the semi-circular partition walls connecting a pair of the horizontal partition walls to each other, the same as mentioned above is applied.

By designing a width of each of the semi-circular partition walls in such a manner as mentioned above, the advantages obtained in the fifth embodiment can be obtained.

In the sixth embodiment, three pairs of vertical or horizontal partition walls are arranged similarly to and coaxially with one another. However, the number of pairs of vertical or horizontal partition walls to be arranged similarly to and coaxially with one another is not to be limited to three. The vertical or horizontal partition walls may be comprised of 2N ones wherein N is a positive integer equal to or greater than two, in which case, a M-th vertical or horizontal partition wall is joined at opposite ends thereof in a length-wise direction to a (2N−M+1)-th vertical or horizontal partition wall through a semi-circular partition wall wherein M is a positive integer in the range of one (1) to N both inclusive.

In the above-mentioned first to sixth embodiments, a partition wall is comprised of a plurality of vertical partition walls and a plurality of horizontal partition walls. However, a partition wall may be comprised of either a plurality of vertical partition walls or a plurality of horizontal partition walls.

Figure 6:
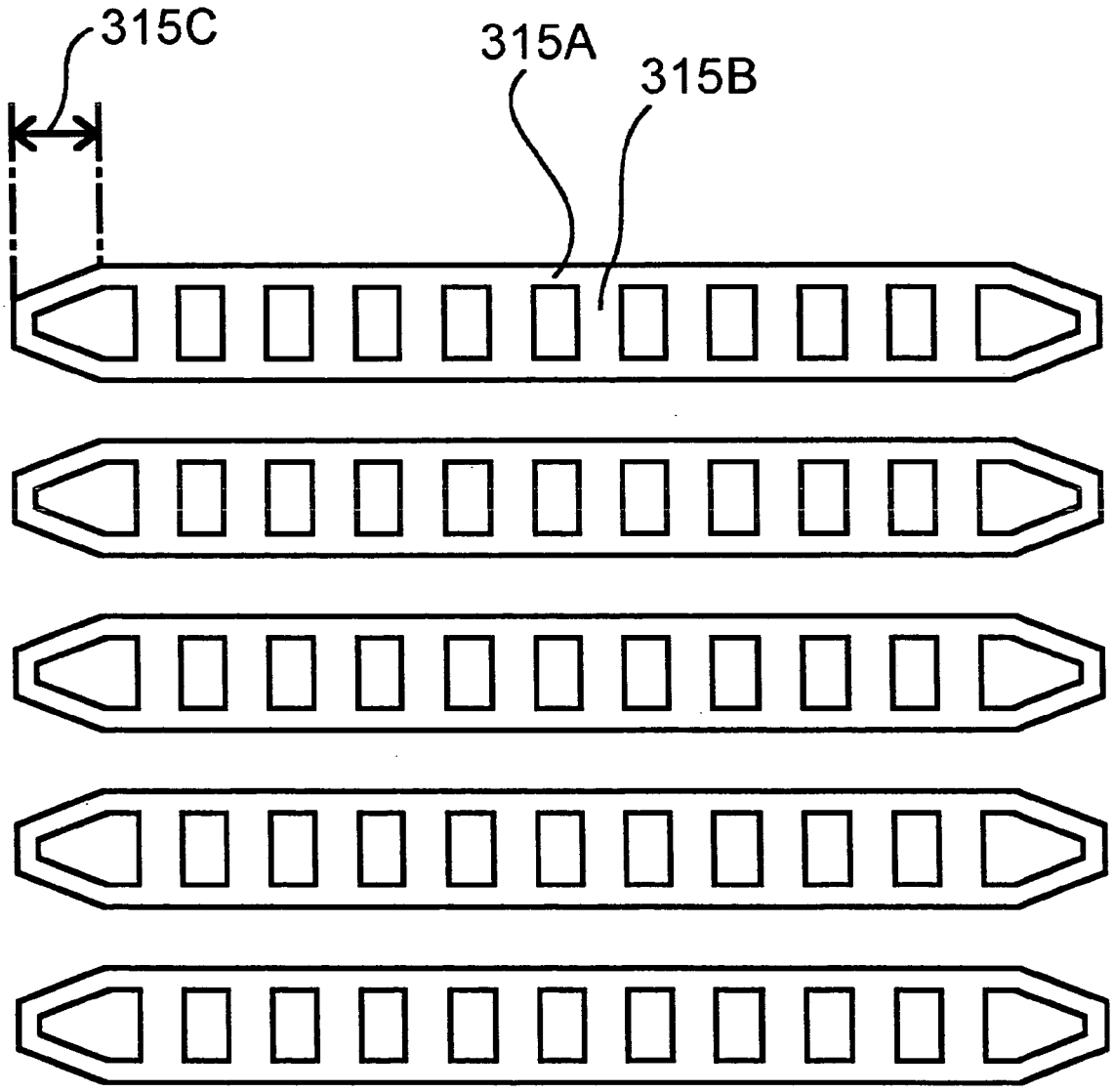
FIG.6 PRIOR ART
FIG. 6 is a plan view illustrating a partition wall in a conventional plasma display panel.
Figure 7:
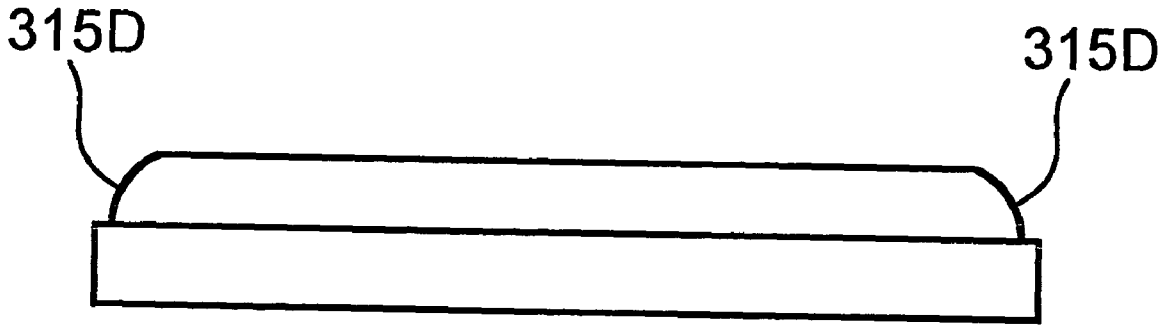
FIG.7 PRIOR ART
FIG. 7 is a plan view illustrating a partition wall in another conventional plasma display panel.

As an alternative, as illustrated in FIG. 6, a partition wall may be comprised of a plurality of horizontal partition walls and a plurality of vertical partition walls extending only between adjacent horizontal partition walls.

[Seventh Embodiment]

Figure 18:
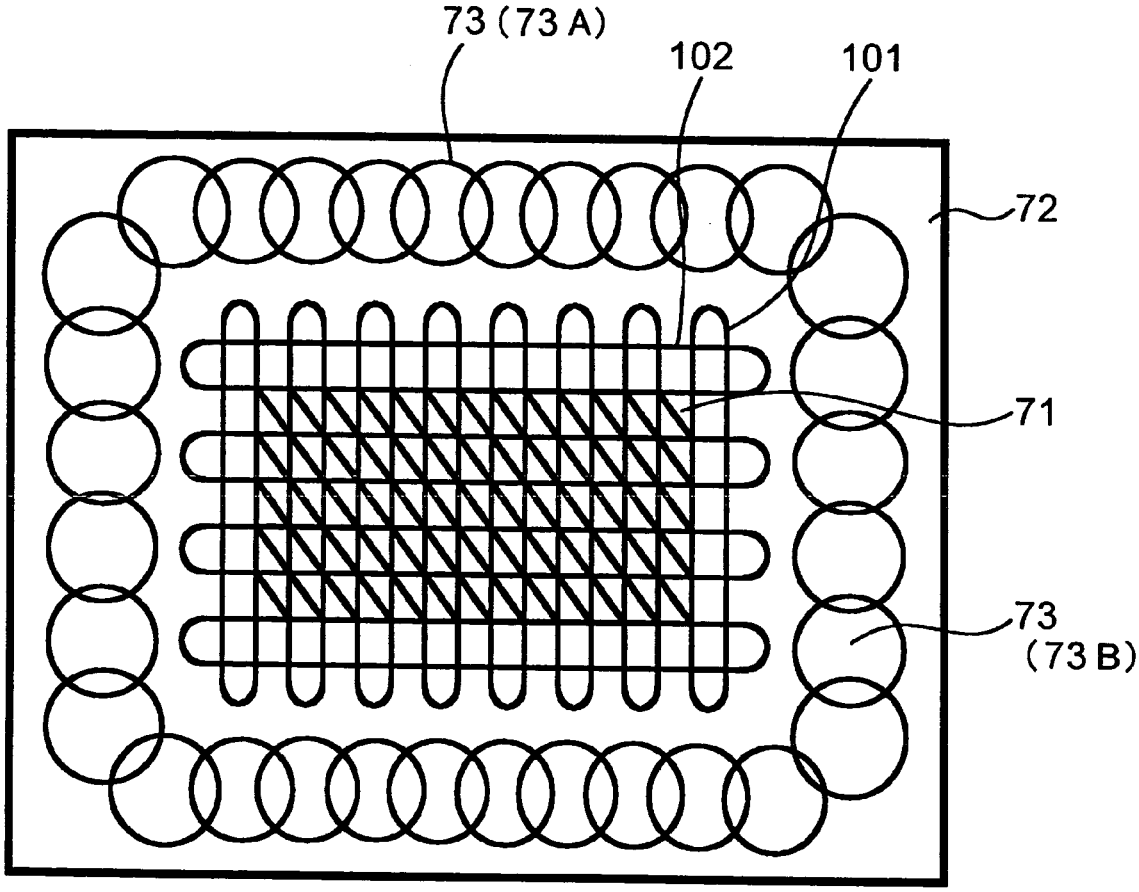
FIG. 18 is a plan view illustrating an outline of a rear substrate in accordance with the eighth embodiment of the present invention.

FIG. 18 is a plan view illustrating an outline of a rear substrate 70 in accordance with the seventh embodiment.

The rear substrate 70 includes a partition wall having the same structure as that of the partition wall in the rear substrate 10 in accordance with the first embodiment, illustrated in FIG. 8.

As illustrated in FIG. 18, the rear substrate 70 has a display area 71, illustrated as a hatched area, in which images are displayed, and a non-display area 72 surrounding the display area 71, in which images are not displayed.

The vertical and horizontal partition walls 101 and 102 are formed entirely in the display area 71 and around a boundary between the display area 71 and the non-display area 72. In the non-display area 72, the vertical and horizontal partition walls 101 and 102 are formed each by two rows such that they surround the display area 71. These two rows of the vertical and horizontal partition walls 101 and 102 are dummy partition walls. The formation of dummy partition walls makes it possible to uniformly form the vertical and horizontal partition walls 101 and 102 in the display area 71 during fabrication of a plasma display panel, and prevent contaminants from invading into the display area 71 after fabrication of a plasma display panel.

In the rear substrate 70, flit-stoppers 73 are formed on the substrate 301 in the non-display area 72 in facing relation to opposite ends of a pair of the vertical and horizontal partition walls 101 and 102 joined to each other through the semi-circular partition wall 103.

Each of the flit-stoppers 73 is circular, and is located on a line passing through a center between a pair of the vertical or horizontal partition walls 101 or 102 joined to each other through the semi-circular partition wall 103, in a width-wise direction of the vertical or horizontal partition walls 101 or 102.

The flit-stoppers 73A located in facing relation to pairs of the vertical partition walls 101 have a common diameter, and similarly, the flit-stoppers 73B located in facing relation to pairs of the horizontal partition walls 102 have a common diameter.

Assuming that each of the flit-stoppers 73 has a diameter D, the flit-stoppers 73 located adjacent to each other overlap each other by D/3. The flit-stoppers 73 thus overlapping adjacent flit-stoppers are arranged in a rectangle such that they surround the display area 71.

Conventional flit-stoppers are arranged in the form of a frame in the non-display area 72 such that they surround the display area 71. By designing flit-stoppers to be circular as in the seventh embodiment, it would be possible to reduce a space occupied by the flit-stoppers. Furthermore, by arranging the flit-stoppers 73 in facing relation to a pair of the vertical or horizontal partition walls 101 or 102, it would be possible to surely adhere the front substrate 351 and the rear substrate 352 to each other around the vertical and horizontal partition walls 101 and 102.

The flit-stoppers 73 are not to be limited to circular in shape. The flit-stoppers 73 may be comprised of any curves. For instance, the flit-stoppers 73 may be designed to be elliptic.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-264352 filed on Sep. 10, 2002 including specification, claims, drawings and summary is incorporated herein by reference in its entirety.

What is claimed is:

1. A rear substrate in a plasma display panel comprising:

(a) an electrically insulating substrate having a display area and a non-display area surrounding the display area;

(b) a plurality of data electrodes arranged on the electrically insulating substrate and spaced away from one another in the display area;

(c) a plurality of partition walls formed in the display area and around a boundary between the display area and the non-display area on the electrically insulating substrate;

(d) a phosphor layer covering the electrically insulating substrate and the data electrodes therewith between adjacent partition walls; and (e) curved partition walls formed in the non-display area, each joining at least two partition walls extending in the same direction.

2. The rear substrate as set forth in claim 1, wherein the at least two partition walls are arranged adjacent to each other.

3. The rear substrate as set forth in claim 1, wherein the partition walls include first, second, third and fourth partition walls arranged in this order, and wherein the first and third partition walls are connected at at least one of opposite ends thereof in a length-wise direction to each other through a first curved partition wall, the second and fourth partition walls are connected at at least one of opposite ends thereof in a length-wise direction to each other through a second curved partition wall, and the first and second curved partition walls intersect with each other.

4. The rear substrate as set forth in claim 1, wherein every N partition walls among the partition walls are connected at at least one of opposite ends thereof in a length-wise direction to each other through the curved partition wall, the N being a positive integer equal to or greater than one.

5. The rear substrate as set forth in claim 1, wherein a first pair of partition walls among the partition walls is connected at at least one of opposite ends thereof in a length-wise direction to each other through the curved partition wall, a second pair of partition wall is surrounded by the first pair of partition walls, and the second pair of partition walls among the partition walls is connected at at least one of opposite ends thereof in a length-wise direction to each other through the curved partition wall.

6. The rear substrate as set forth in claim 1, wherein the partition walls are comprised of 2N partition walls, N being a positive integer equal to or greater than two, and wherein a M-th partition wall is connected at at least one of opposite ends thereof in a length-wise direction to an associated end of a (2N−M+1)-th partition wall through the curved partition wall, M being a positive integer in the range of one (1) to N both inclusive.

7. The rear substrate as set forth in claim 6, wherein a curved partition wall connecting the M-th partition wall and the (2N−M+1)-th partition wall to each other therethrough has a width equal to or greater than a width of a curved partition wall connecting a (M+1)-th partition wall and a (2N−M)-th partition wall to each other therethrough.

8. The rear substrate as set forth in claim 6, wherein one of the M-th partition wall and the (2N−M+1)-th partition wall wherein M is equal to one (1) is located outermost of a display area of the plasma display panel.

9. The rear substrate as set forth in claim 1, wherein the curved partition wall is semi-circular.

10. The rear substrate as set forth in claim 1, wherein the partition walls extend in a first direction in parallel with one another.

11. The rear substrate as set forth in claim 1, wherein each of the partition walls is comprised of a first partition wall extending in a first direction and a second partition wall extending in a second direction perpendicular to the first direction.

12. The rear substrate as set forth in claim 1, wherein each of the partition walls is comprised of a first partition wall extending in a first direction and a second partition wall extending in a second direction perpendicular to the first direction only between adjacent first partition walls.

13. The rear substrate as set forth in claim 1 further comprising flit-stoppers arranged in the non-display area in facing relation to a pair of partition walls connected at at least one of opposite ends thereof in a length-wise direction to each other through the curved partition wall, the flit-stoppers are comprised of curved lines, and the flit-stoppers are arranged each overlapping adjacent flit-stoppers, and surround the display area.

14. The rear substrate as set forth in claim 13, wherein each of the flit-stoppers is circular.

15. A plasma display panel comprising a first substrate through which an image is transmitted to a viewer, and a second substrate arranged in facing relation to the first substrate, the first substrate comprising:

(A) a first transparent substrate;

(B) at least one scanning electrode formed on the first transparent substrate in facing relation to the second substrate;

(C) at least one common electrode formed on the first transparent substrate in facing relation to the second substrate; and (D) a dielectric layer covering the first transparent substrate, the scanning electrode and the common electrode therewith, the second substrate comprising:

(a) an electrically insulating substrate having a display area and a non-display area surrounding the display area;

(b) a plurality of data electrodes arranged on the electrically insulating substrate and spaced away from one another in the display area;

(c) a plurality of partition walls formed in the display area and around a boundary between the display area and the non-display area on the electrically insulating substrate; and (d) a phosphor layer covering the electrically insulating substrate and the data electrodes therewith between adjacent partition walls; and (e) curved partition walls formed in the non-display area, each joining at least two partition walls extending in the same direction as a direction.

16. The plasma display panel as set forth in claim 15, wherein the at least two partition walls are arranged adjacent to each other.

17. The plasma display panel as set forth in claim 15, wherein the partition walls include first, second, third and fourth partition walls arranged in this order, and wherein the first and third partition walls are connected at at least one of opposite ends thereof in a length-wise direction to each other through a first curved partition wall, the second and fourth partition walls are connected at at least one of opposite ends thereof in a length-wise direction to each other through a second curved partition wall, and the first and second curved partition walls intersect with each other.

18. The plasma display panel as set forth in claim 15, wherein every N partition walls among the partition walls are connected at at least one of opposite ends thereof in a length-wise direction to each other through the curved partition wall, the N being a positive integer equal to or greater than one.

19. The plasma display panel as set forth in claim 15, wherein the partition walls are comprised of 2N partition walls, N being a positive integer equal to or greater than two, and wherein a M-th partition wall is connected at at least one of opposite ends thereof in a length-wise direction to an associated end of a (2N−M+1)-th partition wall through the curved partition wall, M being a positive integer in the range of one (1) to N both inclusive.

20. The plasma display panel as set forth in claim 19, wherein a curved partition wall connecting the M-th partition wall and the (2N−M+1)-th partition wall to each other therethrough has a width equal to or greater than a width of a curved partition wall connecting a (M+1)-th partition wall and a (2N−M)-th partition wall to each other therethrough.

* * * * *

UNITED STATES PATENT AND TRADEMARK OFFICE

CERTIFICATE OF CORRECTION

PATENT NO. : 6,977,467 B2
APPLICATION NO. : 10/657101
DATED : December 20, 2005
INVENTOR(S) : Yoshitaka Kawanishi It is certified that error appears in the above-identified patent and that said Letters Patent is hereby corrected as shown below:

Under Assignee:

Please delete: ~~NEC Plasma Display Corporation, Tokyo (JP)~~; and insert: Pioneer Corporation, Tokyo (JP)

Signed and Sealed this

Seventeenth Day of October, 2006

JON W. DUDAS
*Director of the United States Patent and Trademark Office*